US006980187B2

(12) United States Patent
Toriumi

(10) Patent No.: US 6,980,187 B2
(45) Date of Patent: Dec. 27, 2005

(54) DISPLAY DRIVER CIRCUIT AND DISPLAY PANEL INCLUDING THE SAME

(75) Inventor: Yuichi Toriumi, Chino (JP)

(73) Assignee: Seiko Epson Corporation, Tokyo (JP)

( * ) Notice: Subject to any disclaimer, the term of this patent is extended or adjusted under 35 U.S.C. 154(b) by 223 days.

(21) Appl. No.: 10/377,415

(22) Filed: Feb. 27, 2003

(65) Prior Publication Data

US 2003/0179171 A1 Sep. 25, 2003

(30) Foreign Application Priority Data

Mar. 5, 2002 (JP) ..... 2002-059148

(51) Int. Cl.[7] ..... G09G 3/36
(52) U.S. Cl. ..... 345/89; 345/100; 345/690
(58) Field of Search ..... 345/89, 90, 100, 345/690

(56) References Cited

U.S. PATENT DOCUMENTS

| | | | | |
|---|---|---|---|---|
| 5,726,676 | A * | 3/1998 | Callahan et al. | 345/98 |
| 6,222,518 | B1 * | 4/2001 | Ikeda et al. | 345/98 |
| 6,750,835 | B2 * | 6/2004 | Azami | 345/89 |
| 6,825,826 | B1 * | 11/2004 | Mikami et al. | 345/98 |

FOREIGN PATENT DOCUMENTS

| | | |
|---|---|---|
| JP | 09-182004 | 7/1997 |
| JP | 2000-250495 | 9/2000 |
| JP | 2001-166750 | 6/2001 |
| JP | 2001-188499 | 7/2001 |
| JP | 2002-014657 | 1/2002 |

* cited by examiner

*Primary Examiner*—Richard Hjerpe
*Assistant Examiner*—Tammy Pham
(74) *Attorney, Agent, or Firm*—Hogan & Hartson, LLP

(57) ABSTRACT

A display driver circuit holds a gray-scale value in a gray-scale value latch circuit corresponding to a shift output signal from a shift register, and drives first to Mth (M is an integer of two or more) signal electrodes. The gray-scale value latch circuit includes first to Mth gray-scale value latches. First to kth (1≦k<M, k is an integer) gray-scale value latches among the first to Mth gray-scale value latches take in the gray-scale value on a left gray-scale value signal bus based on the shift output signal. (k+1)th to Mth gray-scale value latches among the first to Mth gray-scale value latches take in the gray-scale value on a right gray-scale value signal bus based on the shift output signal. A bus dividing circuit outputs the gray-scale value on a gray-scale value bus to either or both of the left and right gray-scale value signal buses based on a bus dividing signal.

37 Claims, 25 Drawing Sheets

56 ELECTRODE DRIVER CIRCUIT
80
BUFFER
VOLTAGE SELECT CIRCUIT
54 GRAY-SCALE VALUE LATCH CIRCUIT
52 SHIFT REGISTER
58 BUS DIVIDING CIRCUIT
BUS DIVIDING SIGNAL
LEFT GRAY-SCALE VALUE SIGNAL BUS
(FIRST GRAY-SCALE VALUE SIGNAL BUS)
RIGHT GRAY-SCALE VALUE SIGNAL BUS
(SECOND GRAY-SCALE VALUE SIGNAL BUS)
GRAY-SCALE VALUE BUS
GRAY-SCALE VALUE (R,G,B)
SHIFT INPUT
CLK
18

DISPLAY DRIVER CIRCUIT AND DISPLAY PANEL INCLUDING THE SAME

Japanese Patent Application No. 2002-59148 filed on Mar. 5, 2002, is hereby incorporated by reference in its entirety.

BACKGROUND OF THE INVENTION

The present invention relates to a display driver circuit and a display panel.

A liquid crystal panel (display panel in a broad sense) performs color representation by gray-scale (gradation) display, for example. Therefore, a signal driver (signal driver circuit; display driver circuit in a broad sense) which drives the liquid crystal panel includes gray-scale value latches provided corresponding to each signal electrode driver circuit which drives the signal electrode. Each signal electrode driver circuit outputs a drive voltage corresponding to the gray-scale values held in the gray-scale value latches. The gray-scale value is supplied to each gray-scale value latch through a gray-scale value bus provided to each pixel in series. Since the gray-scale value latches are disposed in a chip corresponding to the signal electrodes, the gray-scale value bus is disposed along the direction of the long side of the chip.

BRIEF SUMMARY OF THE INVENTION

One aspect of the present invention relates to a display driver circuit driving first to Mth (M is an integer of two or more) signal electrodes based on gray-scale values, the display driver circuit comprising:

a shift register, in which a plurality of flip-flops are connected in series, outputting shift output signals to be sequentially shifted based on a given clock;

a gray-scale value bus to which the gray-scale values are sequentially supplied corresponding to the clock;

first and second gray-scale value signal buses;

a bus dividing circuit outputting the gray-scale values supplied to the gray-scale value bus to one of the first and second gray-scale value signal buses, based on a given bus dividing signal;

first to kth ($2 \leqq k < M$, k is an integer) gray-scale value latches being provided corresponding to first to kth signal electrodes among the first to Mth signal electrodes, and holding the gray-scale values supplied to the first gray-scale value signal bus based on the shift output signals from the shift register;

(k+1)th to Mth gray-scale value latches being provided corresponding to (k+1)th to Mth signal electrodes among the first to Mth signal electrodes, and holding the gray-scale values supplied to the second gray-scale value signal bus based on the shift output signals from the shift register; and an electrode driver circuit driving the first to Mth signal electrodes based on the gray-scale values held in the first to kth gray-scale value latches and the (k+1)th to Mth gray-scale value latches.

Another aspect of the present invention relates to a display driver circuit driving first to Mth (M is an integer of two or more) signal electrodes based on gray-scale values, the display driver circuit comprising:

a partial operation register being capable of arbitrarily setting whether or not to perform a partial operation for each of blocks, the blocks being formed by dividing the first to Mth signal electrodes;

a shift register, in which a plurality of flip-flops are connected in series, outputting shift output signals to be sequentially shifted based on a given clock;

a gray-scale value bus to which the gray-scale values are sequentially supplied corresponding to the clock;

first and second gray-scale value signal buses;

a bus dividing circuit outputting the gray-scale values supplied to the gray-scale value bus to one of the first and second gray-scale value signal buses, based on a given bus dividing signal;

first to kth ($2 \leqq k < M$, k is an integer) gray-scale value latches being provided corresponding to first to kth signal electrodes among the first to Mth signal electrodes, and holding the gray-scale values supplied to the first gray-scale value signal bus based on the shift output signals from the shift register;

(k+1)th to Mth gray-scale value latches being provided corresponding to (k+1)th to Mth signal electrodes among the first to Mth signal electrodes, and holding the gray-scale values supplied to the second gray-scale value signal bus based on the shift output signals from the shift register; and first to Mth signal electrode driver circuits being provided corresponding to the first to Mth signal electrodes and driving the first to Mth signal electrodes based on the gray-scale values held in the first to Mth gray-scale value latches, wherein an ith ($1 \leqq i \leqq M$, i is an integer) signal electrode driver circuit among the first to Mth signal electrode driver circuits drives an ith signal electrode among the first to Mth signal electrodes by using the most significant bits of each color of the gray-scale values held in the ith gray-scale value latch when the ith signal electrode driver circuit belongs to a block designated by the partial operation register to perform the partial operation, and drives the ith signal electrode based on the gray-scale value held in the ith gray-scale value latch when the ith signal electrode driver circuit belongs to a block designated by the partial operation register not to perform the partial operation, and wherein the bus dividing circuit outputs only the most significant bits of each color of the gray-scale values corresponding to the block designated by the partial operation register to perform the partial operation, to either or both of the first and second gray-scale value signal buses.

Still another aspect of the present invention relates to a display driver circuit driving first to Mth (M is an integer of two or more) signal electrodes based on gray-scale values, the display driver circuit comprising:

a clock bus to which a given clock is supplied;

first and second clock divided buses;

a clock bus dividing circuit outputting the clock supplied to the clock bus, to one of the first and second clock divided buses based on a given clock bus dividing signal;

a first shift register in which first to kth ($2 \leqq k < M$, k is an integer) flip-flops are connected in series and which outputs shift output signal to be sequentially shifted based on the clock which has been output to the first clock divided bus;

a second shift register in which (k+1)th to Mth flip-flops are connected in series and which outputs the shift output signal which is an output of the kth flip-flop and sequentially shifted based on the clock which has been output to the second clock divided bus;

a gray-scale value bus to which the gray-scale value is sequentially supplied corresponding to the clock;

first to Mth gray-scale value latches which are provided corresponding to the first to Mth signal electrodes and hold the gray-scale value supplied to the gray-scale value bus based on the shift output signal from one of the first and second shift registers; and an electrode driver circuit which drives the first to Mth signal electrodes based on the gray-scale values held in the first to Mth gray-scale value latches.

Yet another aspect of the present invention relates to a display driver circuit driving first to Nth (N is an integer of two or more) scan electrodes, the display driver circuit comprising:

a clock bus to which a given clock is supplied;

first and second clock divided buses;

a clock bus dividing circuit outputting the clock supplied to the clock bus, to one of the first and second clock divided buses based on a given clock bus dividing signal;

a first shift register in which first to jth ($1 \leqq j < N$, j is an integer) flip-flops are connected in series and which outputs a shift output signal to be sequentially shifted based on the clock which has been output to the first clock divided bus; and a second shift register in which (j+1)th to Nth flip-flops are connected in series and which outputs the shift output signal which has been sequentially shifted based on the clock output to the second clock divided bus, wherein the first to jth scan electrodes and the (j+1)th to Nth scan electrodes are driven by using a shift output of one of the first and second shift registers.

DETAILED DESCRIPTION OF THE EMBODIMENT

Figure 1:
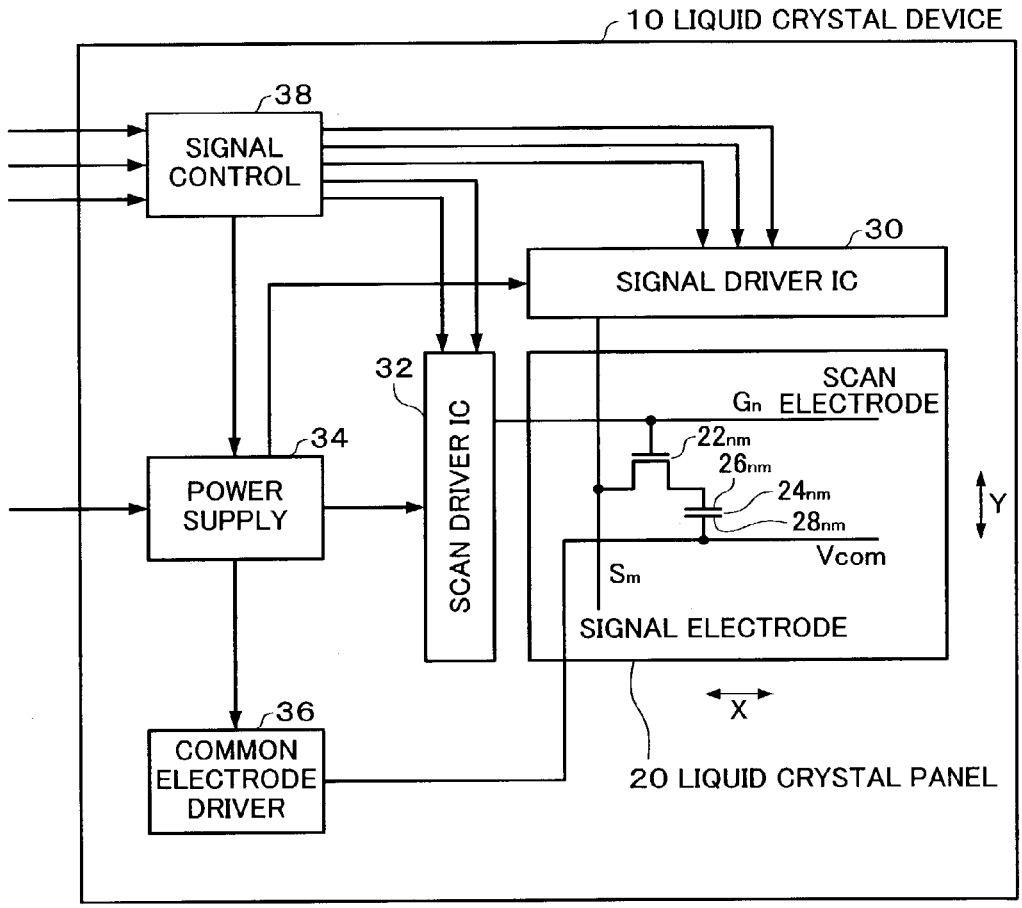
FIG. 1 is a block diagram showing an outline of a configuration of a liquid crystal device.

Embodiments of the present invention are described below. However, the embodiments described below should not be construed as limiting the scope of the present invention described in the claims. The entire configuration described below is not necessarily indispensable for the present invention.

Among a plurality of gray-scale value latches disposed in the direction of the long side of a chip, only the gray-scale value latch to which a shift output signal is input fetches a gray-scale value on a gray-scale value bus. Therefore, if the gray-scale value is supplied to all the gray-scale value latches connected with the gray-scale value bus, an unnecessary drive current is consumed for the gray-scale value bus.

This is not limited to the gray-scale value bus. An unnecessary drive current is also consumed for a bus to which a clock for fetching the gray-scale value or a clock which specifies scanning timing is supplied.

According to the following embodiments, a display driver circuit capable of reducing power consumption by decreasing the load of various buses, and a display panel can be provided.

One embodiment of the present invention relates to a display driver circuit driving first to Mth (M is an integer of two or more) signal electrodes based on gray-scale values, the display driver circuit comprising:

a shift register, in which a plurality of flip-flops are connected in series, outputting shift output signals to be sequentially shifted based on a given clock;

a gray-scale value bus to which the gray-scale values are sequentially supplied corresponding to the clock;

first and second gray-scale value signal buses;

a bus dividing circuit outputting the gray-scale values supplied to the gray-scale value bus to one of the first and second gray-scale value signal buses, based on a given bus dividing signal;

first to kth ($2 \leqq k < M$, k is an integer) gray-scale value latches being provided corresponding to first to kth signal electrodes among the first to Mth signal electrodes, and holding the gray-scale values supplied to the first gray-scale value signal bus based on the shift output signals from the shift register;

(k+1)th to Mth gray-scale value latches being provided corresponding to (k+1)th to Mth signal electrodes among the first to Mth signal electrodes, and holding the gray-scale values supplied to the second gray-scale value signal bus based on the shift output signals from the shift register; and an electrode driver circuit driving the first to Mth signal electrodes based on the gray-scale values held in the first to kth gray-scale value latches and the (k+1)th to Mth gray-scale value latches.

The electrode driver circuit may be formed to output a drive voltage corresponding to the gray-scale values to each signal electrode, for example. The electrode driver circuit may be formed to perform given operations on the gray-scale values for a plurality of signal electrodes and output a drive voltage to each of the signal electrodes according to the operation results, for example.

In this embodiment, in the display driver circuit which holds the gray-scale values for driving the first to Mth signal electrodes in the first to Mth gray-scale value latches provided corresponding to the first to Mth signal electrodes, the gray-scale values on the gray-scale value bus are output to either the first or second gray-scale value signal bus by the bus dividing circuit. This eliminates the need to dispose the gray-scale value bus so as to be connected with all of the first to Mth gray-scale value latches. Therefore, the interconnect length of the gray-scale value bus can be decreased, whereby current consumption accompanied by driving the gray-scale value bus can be reduced. In the case where the first to Mth gray-scale value latches are disposed along the direction of the long side of the chip corresponding to the direction in which the first to Mth signal electrodes are arranged, the interconnect length of the gray-scale value bus is increased. Therefore, the above effect is significantly increased.

In the display driver circuit according to this embodiment, the bus dividing signal may be generated by using the shift output signals for taking one of the gray-scale values in the kth gray-scale value latch.

According to this embodiment, the bus dividing signal is generated by using the shift output signal for taking in the gray-scale values in the kth gray-scale value latch. This enables switching between the first and second gray-scale value signal buses to be realized with a simple configuration. Moreover, a decrease in drive current can be achieved.

In the display driver circuit according to this embodiment, the bus dividing signal may be generated by using a count value of the clock supplied to the shift register.

In this embodiment, the bus dividing signal is generated by using the count value of the clock which specifies shift timing of the shift register. This enables switching between the first and second gray-scale value signal buses to be realized with a simple configuration. Moreover, a decrease in drive current can be achieved.

In the display driver circuit according to this embodiment, the bus dividing signal may be generated based on one of the shift output signals, the shift output signals being output for each of blocks, the blocks being formed by dividing a plurality of the flip-flops forming the shift register.

In this embodiment, the shift output signal is output for each of the blocks formed by dividing a plurality of the flip-flops forming the shift register, and the bus dividing signal is generated by using the shift output signals. This enables the first and second gray-scale value signal buses to be switched for each of the blocks at an arbitrary timing, whereby the bus can be divided depending on the number of signal electrodes to be driven.

In the display driver circuit according to this embodiment, the bus dividing circuit may output the gray-scale values to both of the first and second gray-scale value signal buses in a given period for switching from the first gray-scale value signal bus to the second gray-scale value signal bus based on the bus dividing signal.

The given period for switching may be a given period at the time of switching. This period may be a given period including the time of switching (switch timing).

In this embodiment, the bus dividing circuit outputs the gray-scale values on the gray-scale value bus to the first and second gray-scale value signal buses in the given period for switching from the first gray-scale value signal bus to the second gray-scale value signal bus. This prevents the gray-scale values on the bus in an unstable state due to switching to the second gray-scale value signal bus from being held in the gray-scale value latch, whereby unstable operations can be prevented.

Moreover, the gray-scale values output to the second gray-scale value signal bus can be latched in a stable state even if the frequency of the clock CLK of the shift register is increased due to an increase in the number of signal electrodes and the like.

Furthermore, it is unnecessary to increase drive capability in order to stably latch the gray-scale values.

In this display driver circuit, since the kth and (k+1)th gray-scale values are continuously supplied to the gray-scale value bus and held in the kth and (k+1)th gray-scale value latches based on the shift output signals from the adjacent flip-flops, the effect of setting the above-described period is significant.

In the display driver circuit according to this embodiment, the given period may be longer than at least a hold time of the kth gray-scale value latch and a setup time of the (k+1)th gray-scale value latch.

In this embodiment, a period in which the gray-scale values on the gray-scale value bus are output to both of the first and second gray-scale value signal buses is provided so as to satisfy the hold time of the kth gray-scale value latch at the final stage in which the gray-scale values on the first gray-scale value signal bus are latched, and the setup time of the (k+1)th gray-scale value latch at the first stage in which the gray-scale values on the second gray-scale value signal bus output by the bus dividing circuit are latched. This allows the gray-scale value latches, which perform latch operations at least before and after switching between the first and second gray-scale value signal buses, to latch the gray-scale value in a stable state.

In the display driver circuit according to this embodiment, the given period may be specified by first and second shift output signals, the first and second shift output signals being output for each of blocks, the blocks being formed by dividing a plurality of the flip-flops forming the shift register.

In this embodiment, a period in which the bus dividing circuit outputs the gray-scale values on the gray-scale value bus to both of the first and second gray-scale value signal buses by using the first and second shift output signals output for each of the blocks is provided. With this configuration, the output period to the first and second gray-scale value signal buses can be arbitrarily provided for each of the blocks, whereby the bus can be divided depending on the number of the signal electrodes to be driven.

Another embodiment of the present invention relates to a display driver circuit driving first to Mth (M is an integer of two or more) signal electrodes based on gray-scale values, the display driver circuit comprising:

a partial operation register being capable of arbitrarily setting whether or not to perform a partial operation for each of blocks, the blocks being formed by dividing the first to Mth signal electrodes;

a shift register, in which a plurality of flip-flops are connected in series, outputting shift output signals to be sequentially shifted based on a given clock;

a gray-scale value bus to which the gray-scale values are sequentially supplied corresponding to the clock;

first and second gray-scale value signal buses;

a bus dividing circuit outputting the gray-scale values supplied to the gray-scale value bus to one of the first and second gray-scale value signal buses, based on a given bus dividing signal;

first to kth ($2 \leqq k < M$, k is an integer) gray-scale value latches being provided corresponding to first to kth signal electrodes among the first to Mth signal electrodes, and holding the gray-scale values supplied to the first gray-scale value signal bus based on the shift output signals from the shift register;

(k+1)th to Mth gray-scale value latches being provided corresponding to (k+1)th to Mth signal electrodes among the first to Mth signal electrodes, and holding the gray-scale values supplied to the second gray-scale value signal bus based on the shift output signals from the shift register; and first to Mth signal electrode driver circuits being provided corresponding to the first to Mth signal electrodes and driving the first to Mth signal electrodes based on the gray-scale values held in the first to Mth gray-scale value latches, wherein an ith ($1 \leqq i \leqq M$, i is an integer) signal electrode driver circuit among the first to Mth signal electrode driver circuits drives an ith signal electrode among the first to Mth signal electrodes by using the most significant bits of each color of the gray-scale values held in the ith gray-scale value latch when the ith signal electrode driver circuit belongs to a block designated by the partial operation register to perform the partial operation, and drives the ith signal electrode based on the gray-scale value held in the ith gray-scale value latch when the ith signal electrode driver circuit belongs to a block designated by the partial operation register not to perform the partial operation, and wherein the bus dividing circuit outputs only the most significant bits of each color of the gray-scale values corresponding to the block designated by the partial operation register to perform the partial operation, to either or both of the first and second gray-scale value signal buses.

The partial operation used herein refers to an operation in which current consumption accompanied by driving the signal electrodes is reduced by decreasing the number of colors to be displayed by driving the signal electrodes by using only the most significant bits of each color without using the lower order bits of each color.

In this embodiment, when a block is designated by the partial operation register to perform the partial operation, the gray-scale values on the gray-scale value bus to be latched by the gray-scale value latch belonging to the block is output to either the first or second gray-scale value signal bus. At this time, only the most significant bits of each color necessary for the partial operation are output. Therefore, current consumption for unnecessary driving can be prevented by masking (fixing) the remaining lower order bits of each color or the like, whereby power consumption due to partial operation can be further reduced.

Still another embodiment of the present invention relates to a display driver circuit driving first to Mth (M is an integer of two or more) signal electrodes based on gray-scale values, the display driver circuit comprising:

a clock bus to which a given clock is supplied;

first and second clock divided buses;

a clock bus dividing circuit outputting the clock supplied to the clock bus, to one of the first and second clock divided buses based on a given clock bus dividing signal;

a first shift register in which first to kth ($2 \leqq k < M$, k is an integer) flip-flops are connected in series and which outputs shift output signal to be sequentially shifted based on the clock which has been output to the first clock divided bus;

a second shift register in which (k+1)th to Mth flip-flops are connected in series and which outputs the shift output signal which is an output of the kth flip-flop and sequentially shifted based on the clock which has been output to the second clock divided bus;

a gray-scale value bus to which the gray-scale value is sequentially supplied corresponding to the clock;

first to Mth gray-scale value latches which are provided corresponding to the first to Mth signal electrodes and hold the gray-scale value supplied to the gray-scale value bus based on the shift output signal from one of the first and second shift registers; and an electrode driver circuit which drives the first to Mth signal electrodes based on the gray-scale values held in the first to Mth gray-scale value latches.

In this embodiment, in the display driver circuit which holds the gray-scale value in the first to Mth gray-scale value latches provided corresponding to the first to Mth signal electrodes based on the shift output signal from the shift register, the first to kth flip-flops among a plurality of the flip-flops which form the shift register are connected with the first clock divided bus, and the (k+1)th to Mth flip-flops are connected with the second clock divided bus. The clock which is supplied to the clock bus and specifies shift timing of the shift register is output to either the first or second clock divided bus by the clock bus dividing circuit. This eliminates the need to dispose the clock bus so as to be connected with all of the first to Mth flip-flops which form the shift register. Therefore, the interconnect length of the clock bus can be decreased, whereby current consumption accompanied by driving the clock bus can be reduced. In the case where the first to Mth flip-flops are disposed along the direction of the long side of the chip according to the direction in which the first to Mth signal electrodes are arranged, the interconnect length of the clock bus is increased. Therefore, the above effect is significantly increased.

In the display driver circuit according to this embodiment, the clock bus dividing circuit may output the clock supplied to the clock bus to both of the first and second clock divided buses in a given period for switching from the first clock divided bus to the second clock divided bus based on the clock bus dividing signal.

The given period for switching may be a given period at the time of switching. This period may be a given period including the time of switching (switch timing).

In this embodiment, the clock bus dividing circuit outputs the clock on the clock bus to both of the first and second clock divided buses in the given period for switching from the first clock divided bus to the second clock divided bus. This prevents the gray-scale value latch from performing latch operations based on an unstable clock due to switching to the second clock divided bus, whereby unstable operations can be prevented.

Moreover, the clock can be output to the second clock divided bus in a stable state even if the frequency of the clock CLK of the shift register is increased due to an increase in the number of signal electrodes and the like.

Furthermore, it is unnecessary to increase drive capability in order to stably output the clock.

In the display driver circuit according to the present embodiment, the given period may be at least one cycle of the clock.

According to this embodiment, since the shift output signal in a stable state can be output to the gray-scale value latch, unstable operations can be prevented.

Yet another embodiment of the present invention relates to a display driver circuit driving first to Nth (N is an integer of two or more) scan electrodes, the display driver circuit comprising:

a clock bus to which a given clock is supplied;

first and second clock divided buses;

a clock bus dividing circuit outputting the clock supplied to the clock bus, to one of the first and second clock divided buses based on a given clock bus dividing signal;

a first shift register in which first to jth ($1 \leqq j < N$, j is an integer) flip-flops are connected in series and which outputs a shift output signal to be sequentially shifted based on the clock which has been output to the first clock divided bus; and a second shift register in which (j+1)th to Nth flip-flops are connected in series and which outputs the shift output signal which has been sequentially shifted based on the clock output to the second clock divided bus, wherein the first to jth scan electrodes and the (j+1)th to Nth scan electrodes are driven by using a shift output of one of the first and second shift registers.

In this embodiment, in the display driver circuit which drives the first to Nth scan electrodes, the first to jth flip-flops among a plurality of the flip-flops which form the shift register are connected with the first clock divided bus, and the (j+1)th to Nth flip-flops are connected with the second clock divided bus. The clock which is supplied to the clock bus and specifies shift timing of the shift register is output to either the first or second clock divided bus by the clock bus dividing circuit. This eliminates the need to dispose the clock bus so as to be connected with all of the first to Nth flip-flops which form the shift register. Therefore, the interconnect length of the clock bus can be decreased, whereby current consumption accompanied by driving the clock bus can be reduced. Since the interconnect length of the clock bus is increased in the case where the first to Nth flip-flops are disposed along the direction of the long side of the chip according to the direction in which the first to Nth scan electrodes are arranged, the above effect is significantly increased.

In the display driver circuit according to this embodiment, the clock bus dividing circuit may output the clock supplied to the clock bus to both of the first and second clock divided buses in a given period for switching from the first clock divided bus to the second clock divided bus based on the clock bus dividing signal.

The given period for switching may be a given period at the time of switching. This period may be a given period including the time of switching (switch timing).

In this embodiment, the clock bus dividing circuit outputs the clock on the clock bus to both of the first and second clock divided buses in the given period for switching from the first clock divided bus to the second clock divided bus. This prevents the gray-scale value latch from performing latch operations based on unstable clock due to switching to the second clock divided bus, whereby unstable operations can be prevented.

Moreover, the clock can be output to the second clock divided bus in a stable state even if the frequency of the clock CLK of the shift register is increased due to an increase in the number of scan electrodes and the like.

Furthermore, it is unnecessary to increase drive capability in order to stably output the clock.

In the display driver circuit according to this embodiment, the given period may be at least one cycle of the clock.

According to this embodiment, since the shift output signal in a stable state can be output, the scan electrode can be stably driven.

A display panel according to the embodiment of the present invention comprises:

a plurality of signal electrodes and a plurality of scan electrodes intersecting each other;

pixels specified by the signal electrodes and the scan electrodes; and any one of the above display driver circuits which drives the signal electrodes.

According to the embodiment of the present invention, power consumption of the display panel can be reduced.

A display panel according to the embodiment of the present invention comprises:

a plurality of signal electrodes and a plurality of scan electrodes intersecting each other;

pixels specified by the signal electrodes and the scan electrodes; and any one of the above display driver circuits which drives the scan electrodes.

According to the embodiment of the present invention, power consumption of the display panel can be reduced.

The embodiments of the present invention are described below in detail with reference to the drawings.

1. Liquid Crystal Device

FIG. 1 shows an outline of a configuration of a liquid crystal device.

The following description is given on the assumption that a liquid crystal device (electro-optical device or display device in a broad sense) 10 is a TFT liquid crystal device. However, the liquid crystal device 10 may be a simple matrix type liquid crystal device.

The liquid crystal device 10 includes a liquid crystal panel (display panel in a broad sense) 20.

The liquid crystal panel 20 is formed on a glass substrate, for example. First to Nth (N is an integer of two or more) scan electrodes (gate lines) $G_1$ to $G_N$ which are arranged in the Y direction and extend in the X direction, and first to Mth (M is an integer of two or more) signal electrodes (source lines) $S_1$ to $S_M$ which are arranged in the X direction and extend in the Y direction are disposed on the glass substrate. A pixel (pixel region) is disposed corresponding to the intersecting point of the nth ($1 \leqq n \leqq N$, n is an integer) scan electrode $G_n$ and the mth ($1 \leqq m \leqq M$, m is an integer) signal electrode $S_m$. The pixel includes a TFT (pixel switch element in a broad sense) $\mathbf{22}_{nm}$.

A gate electrode of the TFT $\mathbf{22}_{nm}$ is connected with the nth scan electrode $G_n$. A source electrode of the TFT $\mathbf{22}_{nm}$ is connected with the mth signal electrode $S_m$. A drain electrode of the TFT $\mathbf{22}_{nm}$ is connected with a pixel electrode $\mathbf{26}_{nm}$ of a liquid crystal capacitance (liquid crystal element in a broad sense) $\mathbf{24}_{nm}$.

The liquid crystal capacitance $24_{nm}$ is formed by sealing a liquid crystal between the pixel electrode $26_{nm}$ and a common electrode $28_{nm}$ opposite to the pixel electrode $26_{nm}$. The transmittance of the pixel is changed corresponding to the voltage applied between these electrodes. A common electrode voltage Vcom is supplied to the common electrode $28_{nm}$.

The liquid crystal device 10 may include a signal driver IC 30. A signal driver to which a display driver circuit in an embodiment described below is applied may be used as the signal driver IC 30. The signal driver IC 30 drives the first to Mth signal electrodes $S_1$ to $S_M$ of the liquid crystal panel 20 based on image data.

The liquid crystal device 10 may include a scan driver IC 32. A scan driver to which a display driver circuit in an embodiment described below is applied may be used as the scan driver IC 32. The scan driver IC 32 sequentially drives the first to Nth scan electrodes $G_1$ to $G_N$ of the liquid crystal panel 20 within one vertical scanning period.

The liquid crystal device 10 may include a power supply circuit 34. The power supply circuit 34 generates a voltage necessary for driving the signal electrode and supplies the voltage to the signal driver IC 30. The power supply circuit 34 generates a voltage necessary for driving the scan electrode and supplies the voltage to the scan driver IC 32.

The liquid crystal device 10 may include a common electrode driver circuit 36. A common electrode voltage Vcom generated by the power supply circuit 34 is supplied to the common electrode driver circuit 36. The common electrode driver circuit 36 outputs the common electrode voltage Vcom to the common electrode of the liquid crystal panel 20.

The liquid crystal device 10 may include a signal control circuit 38. The signal control circuit 38 controls the signal driver IC 30, the scan driver IC 32, and the power supply circuit 34 according to the content set by a host such as a central processing unit (hereinafter abbreviated as "CPU") (not shown). For example, the signal control circuit 38 supplies setting of the operation mode and a vertical synchronization signal or a horizontal synchronization signal generated therein to the signal driver IC 30 and the scan driver IC 32. The signal control circuit 38 controls polarity inversion timing of the power supply circuit 34.

A gray-scale value consisting of six bits each for RGB (18 bits in total) is sequentially input to the liquid crystal device 10 in a unit of pixels from the host (not shown), for example. The signal driver IC 30 latches the gray-scale value and drives the first to Mth signal electrodes $S_1$ to $S_M$.

In FIG. 1, the liquid crystal device 10 includes the power supply circuit 34, the common electrode driver circuit 36, and the signal control circuit 38. However, at least one of these circuits may be provided outside the liquid crystal device 10. The liquid crystal device 10 may include the host.

Figure 2:
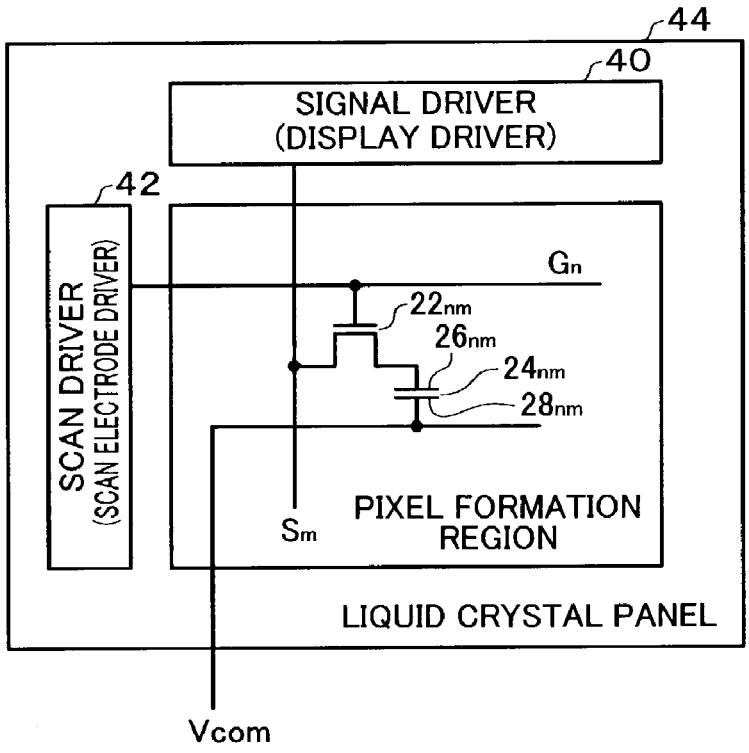
FIG. 2 is a block diagram showing an outline of a configuration of a liquid crystal panel.

As shown in FIG. 2, a signal driver (display driver circuit in a broad sense) 40 having a function of the signal driver IC 30 and a scan driver (scan electrode driver circuit in a broad sense; a display driver circuit in a broader sense) 42 having a function of the scan driver IC 32 may be formed on a glass substrate on which a liquid crystal panel 44 is formed so that the liquid crystal panel 44 is included in the liquid crystal device 10. Only either the signal driver 40 or the scan driver 42 may be formed on the glass substrate on which the liquid crystal panel 44 is formed.

2. Display Driver Circuit

Figure 3:
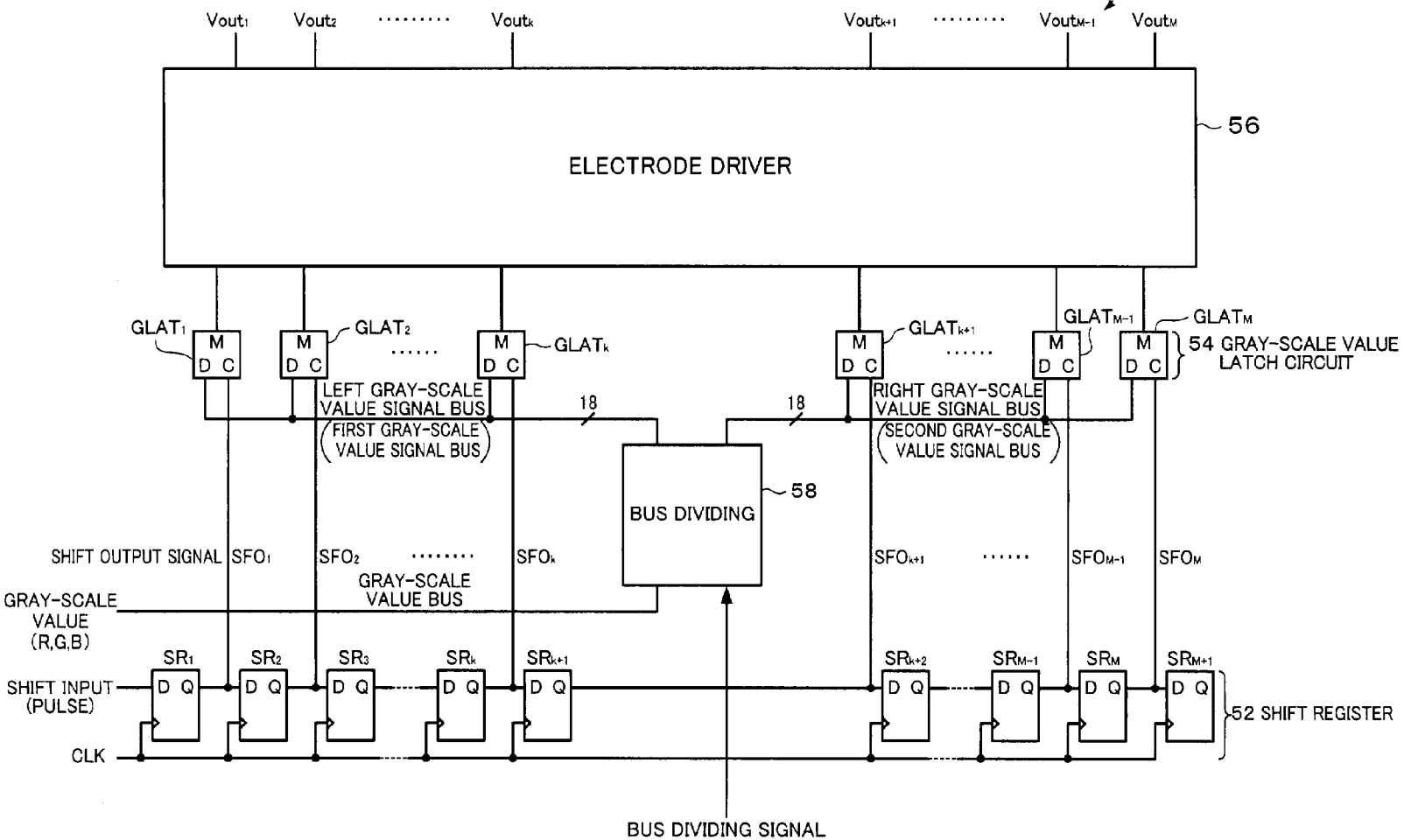
FIG. 3 is a block diagram showing an outline of a configuration of a signal driver to which a display driver circuit is applied.

FIG. 3 shows an outline of a configuration of a signal driver to which a display driver circuit in an embodiment described below is applied.

A signal driver 50 includes a shift register 52, a gray-scale value latch circuit 54, an electrode driver circuit 56, and a bus dividing circuit 58. The signal driver 50 holds the gray-scale value in the gray-scale value latch circuit 54 based on a shift output signal from the shift register 52, and drives the first to Mth signal electrodes of the liquid crystal panel 20 by the electrode driver circuit 56.

In more detail, the shift register 52 includes a plurality of flip-flops $SR_1$ to $SR_{M+1}$. Outputs of the flip-flops $SR_1$ to $SR_M$ are connected in series. A given clock CLK is input in common to C terminals (clock input terminals) of the flip-flops $SR_1$ to $SR_{M+1}$. The flip-flops $SR_2$ to $SR_M$ latch the shift output signal at the preceding stage input to D terminals (data input terminals) at a rising edge of the clock CLK, and output shift output signals $SFO_2$ to $SFO_M$ from Q terminals (data output terminals). A negative logic pulse is input to a D terminal of the flip-flop $SR_1$ which makes up the shift register 52 as a shift input. The pulse is sequentially output from the shift register 52 as the shift output signals $SFO_1$ to $SFO_M$ in synchronization with a rising edge of the clock CLK.

The gray-scale value latch circuit 54 includes first to Mth gray-scale value latches $GLAT_1$ to $GLAT_M$ provided corresponding to the first to Mth signal electrodes. Each of the first to Mth gray-scale value latches $GLAT_1$ to $GLAT_M$ holds the logic level of the D terminal at a rising edge of the signal input to the C terminal in a period in which the signal input to the C terminal is at a logic level "H". The first to kth gray-scale value latches $GLAT_1$ to $GLAT_k$ ($2 \leqq k < M$, k is an integer) are connected with a left gray-scale value signal bus (first gray-scale value signal bus), and latch the gray-scale value on the left gray-scale value signal bus based on the shift output signals $SFO_1$ to $SFO_k$ from the shift register 52. The (k+1)th to Mth gray-scale value latches $GLAT_{k+1}$ to $GLAT_M$ are connected with a right gray-scale value signal bus (second gray-scale value signal bus), and latch the gray-scale value on the right gray-scale value signal bus based on the shift output signals $SFO_{k+1}$ to $SFO_M$ from the shift register 52.

The electrode driver circuit 56 outputs drive voltages $Vout_1$ to $Vout_M$ based on the gray-scale values held in the first to Mth gray-scale value latches $GLAT_1$ to $GLAT_M$. In the case where the electrode driver circuit 56 drives the signal electrodes of a TFT liquid crystal device, the electrode driver circuit 56 generates voltages corresponding to the 18-bit gray-scale values held in the first to Mth gray-scale value latches $GLAT_1$ to $GLAT_M$ for each of the first to Mth signal electrodes, and outputs the voltages to the signal electrodes. In the case where the electrode driver circuit 56 drives the signal electrodes of a simple matrix type liquid crystal device, the electrode driver circuit 56 performs given multi-line selection (MLS) operations for each of a plurality of signal electrodes corresponding to a plurality of scan electrodes simultaneously selected by an MLS drive method by using the gray-scale values held in the first to Mth gray-scale value latches $GLAT_1$ to $GLAT_M$, and outputs voltages based on the operation results to the signal electrodes.

The bus dividing circuit 58 outputs the gray-scale value (six bits each for RGB, 18 bits in total) on the gray-scale value bus which is supplied in a unit of pixels in response to the clock CLK to either or both of the left and right gray-scale value signal buses based on a given bus dividing signal.

2.1 COMPARATIVE EXAMPLE

The signal driver 50 having the above-described configuration is described below by contrast with a comparative example.

Figure 4:
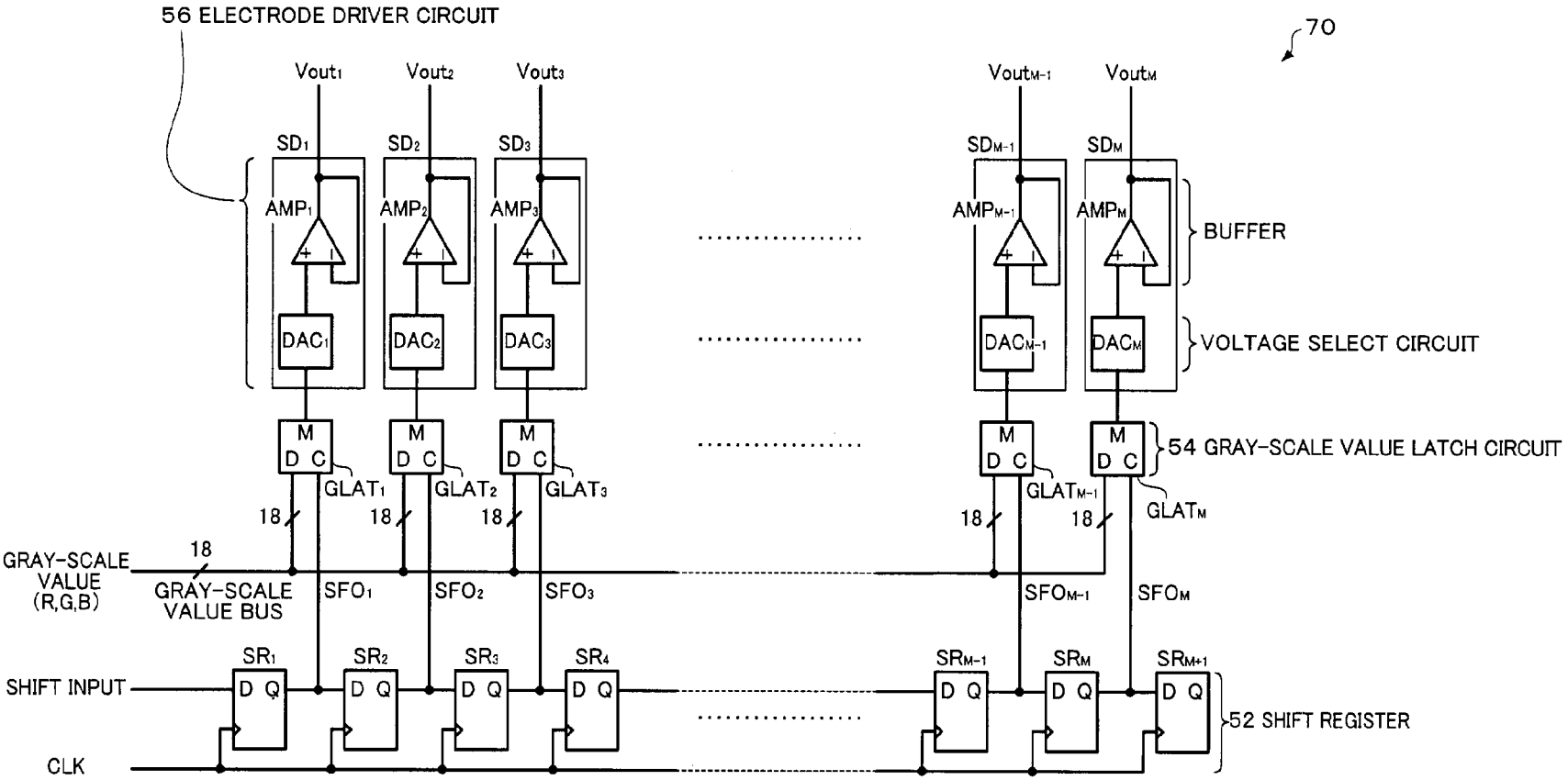
FIG. 4 is a block diagram showing a configuration of a signal driver in a comparative example.

FIG. 4 shows a configuration of a signal driver in the comparative example.

In FIG. 4, sections the same as those of the signal driver 50 shown in FIG. 3 are indicated by the same symbols. Description of these sections is appropriately omitted.

A signal driver 70 in the comparative example includes the shift register 52, the gray-scale value latch circuit 54, and the electrode driver circuit 56. The electrode driver circuit 56 includes first to Mth signal driver circuits $SD_1$ to $SD_M$, each having a DAC (voltage select circuit in a broad sense) and a buffer, for each electrode to be driven. The pth ($1 \leqq p \leqq M$, p is an integer) voltage select circuit $DAC_p$ selects the drive voltage from a plurality of reference voltages based on the gray-scale value held in the pth gray-scale value latch $GLAT_p$. The pth buffer $AMP_p$ includes a voltage follower connected operational amplifier. The pth buffer $AMP_p$ drives the pth signal electrode by using the drive voltage output from the pth voltage select circuit $DAC_p$.

Figure 5:
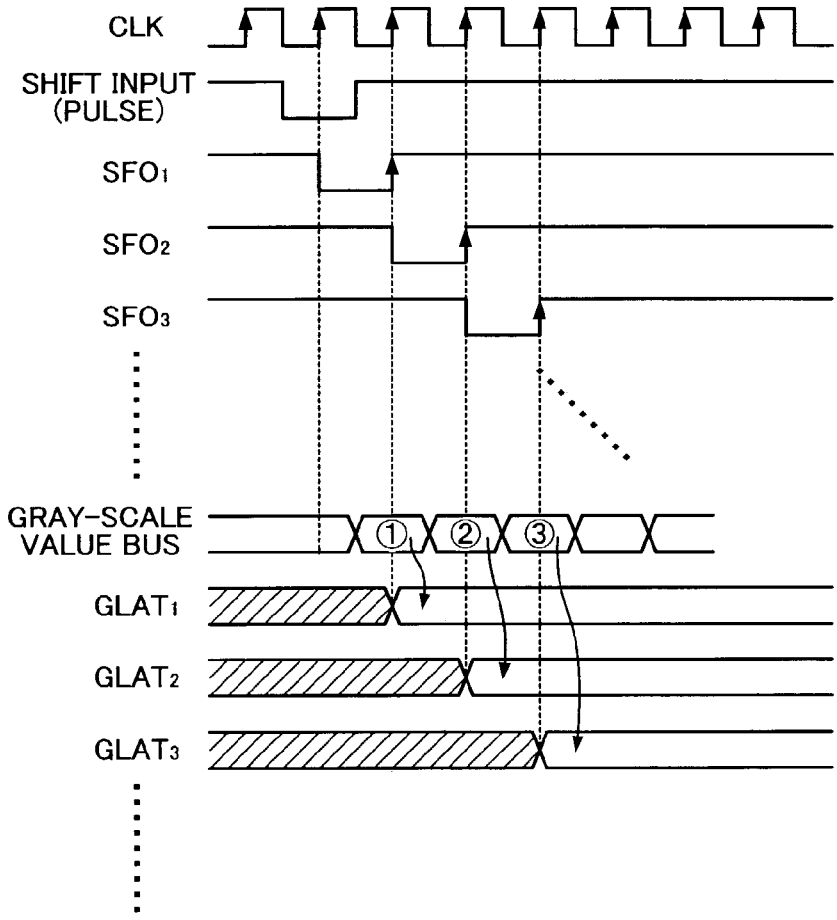
FIG. 5 is a timing chart showing an example of operation timing of the signal driver in the comparative example.

FIG. 5 shows an example of fetch timing of the gray-scale value of the signal driver 70 in the comparative example.

The clock CLK is input in common to each flip-flop which makes up the shift register 52. When a negative logic pulse is input as the shift input, the pulse is sequentially shifted by each flip-flop in synchronization with a rising edge of the clock CLK.

The gray-scale value is sequentially supplied to the gray-scale value bus in synchronization with the clock CLK. The first gray-scale value latch $GLAT_1$ holds the gray-scale value at a rising edge of the shift output signal $SFO_1$. The second to Mth gray-scale value latches $GLAT_2$ to $GLAT_M$ hold the gray-scale value on the gray-scale value bus at rising edges of the shift output signals $SFO_2$ to $SFO_M$.

In the signal driver 70, the first to Mth gray-scale value latches $GLAT_1$ to $GLAT_M$ are connected in common with the gray-scale value bus. In the signal driver 50 shown in FIG. 3, the first to Mth gray-scale value latches $GLAT_1$ to $GLAT_M$ are connected in common with the left gray-scale value signal bus and the right gray-scale value signal bus into which the gray-scale value bus is divided.

Figure 6:
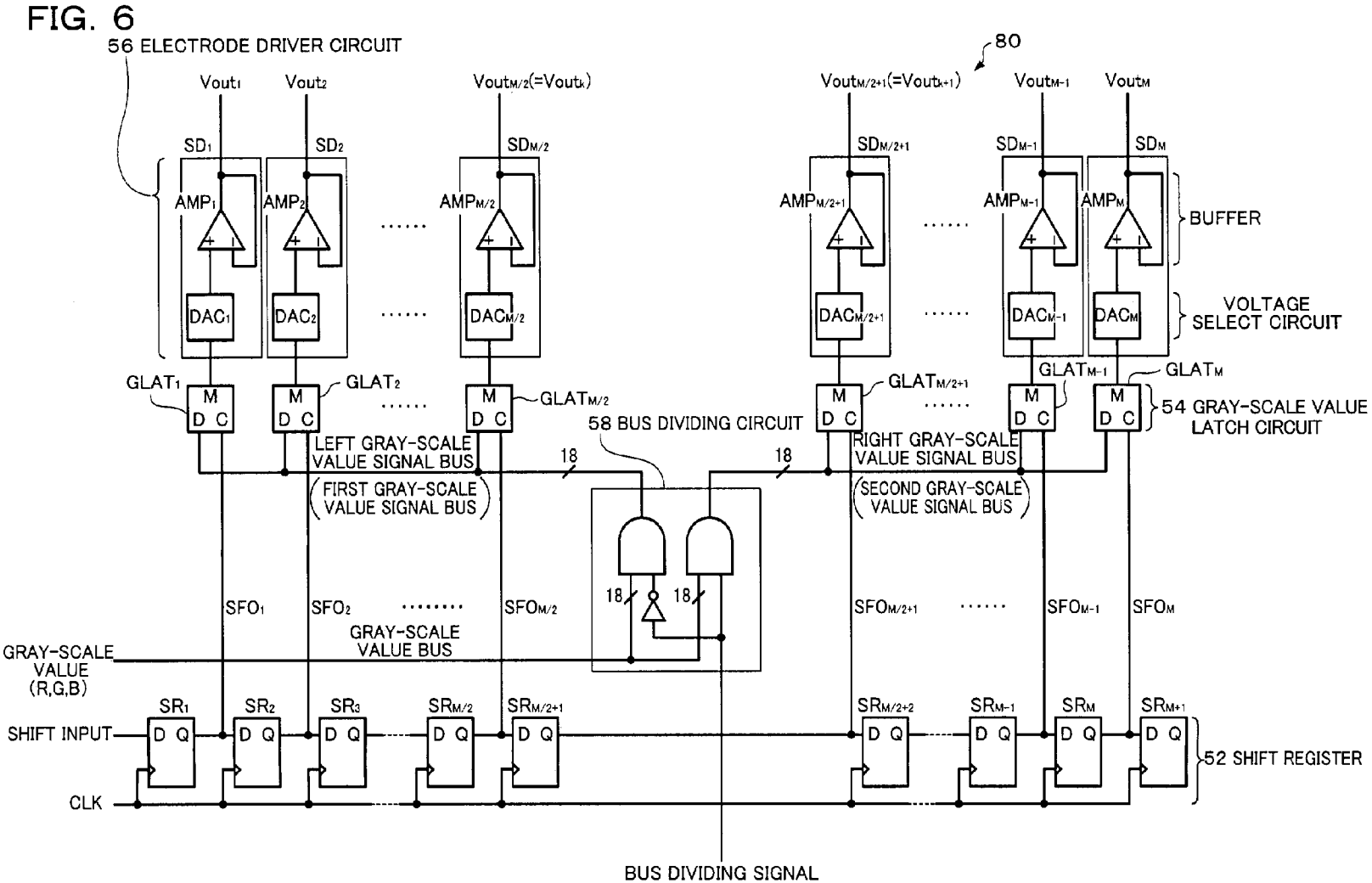
FIG. 6 is a block diagram showing an outline of a configuration of a signal driver in which a selector circuit is used as a bus dividing circuit.

FIG. 6 shows a configuration example of the signal driver in the case where a selector circuit is used as the bus dividing circuit shown in FIG. 3.

In FIG. 6, sections of a signal driver 80 the same as those of the signal driver 50 shown in FIG. 3 are indicated by the same symbols. Description of these sections is appropriately omitted. In the signal driver 80, the electrode driver circuit has the same configuration as the electrode driver circuit of the signal driver 70 in the comparative example. In this example, k is M/2 (if M/2 is not an integer, k is the nearest integer). Drive current can be effectively decreased by making k approximately half of M, because inequality of the interconnect length between the left gray-scale value signal bus and the right gray-scale value signal bus can be prevented.

When the bus dividing signal is at a logic level "L", the bus dividing circuit 58 outputs the gray-scale value on the gray-scale value bus to the left gray-scale value signal bus (first gray-scale value signal bus) and masks the output to the right gray-scale value signal bus (second gray-scale value signal bus) to allow a logic level "L" to be output to the right gray-scale value signal bus. When the bus dividing signal is at a logic level "H", the bus dividing circuit 58 outputs the gray-scale value on the gray-scale value bus to the right gray-scale value signal bus (second gray-scale value signal bus) and masks the output to the left gray-scale value signal bus (first gray-scale value signal bus) to allow a logic level "L" to be output the left gray-scale value signal bus.

Figure 7:
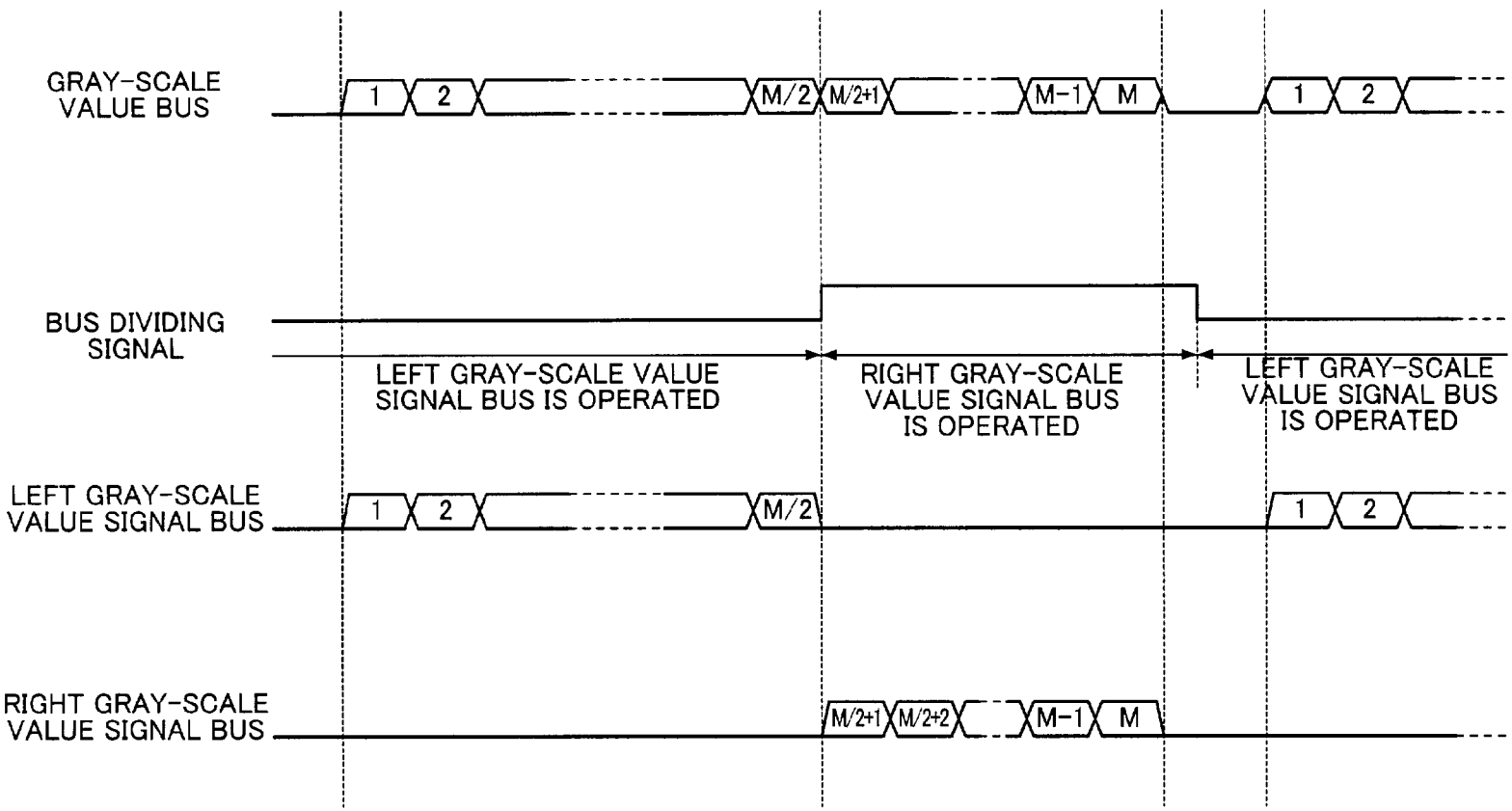
FIG. 7 is a timing chart showing an example of operation timing of the signal driver shown in FIG. 6.

FIG. 7 shows an example of fetch timing of the gray-scale value of the signal driver 80 shown in FIG. 6.

The gray-scale value is sequentially supplied to the gray-scale value bus in synchronization with the clock CLK.

For example, the bus dividing signal is at a logic level "L" in a period between the start of a horizontal scanning period and the fetch timing of the (M/2)th (=kth) gray-scale value latch $GLAT_{M/2}$, whereby the gray-scale value on the gray-scale value bus is output to the left gray-scale value signal bus. The gray-scale value output to the left gray-scale value signal bus is fetched by the first to (M/2) th gray-scale value latches $GLAT_1$ to $GLAT_{M/2}$ based on the shift output signals $SFO_1$ to $SFO_{M/2}$.

Then, the logic level of the bus dividing signal becomes "H", whereby the gray-scale value on the gray-scale value bus is output to the right gray-scale value signal bus. The gray-scale value output to the right gray-scale value signal bus is fetched by the (M/2+1)th to Mth gray-scale value latches $GLAT_{M/2+1}$ to $GLAT_M$ based on the shift output signals $SFO_{M/2+1}$ to $SFO_M$.

The logic level of the bus dividing signal becomes "L" when the next horizontal scanning period starts. The gray-scale value is thereafter fetched in the same manner as described above.

In the signal driver 80, it is unnecessary to connect the gray-scale value bus with all the gray-scale value latches differing from the signal driver 70 in the comparative example shown in FIG. 4. Generally, the gray-scale value latches are disposed along the direction in which the signal electrodes are arranged. Therefore, the interconnect length of the bus connected with the gray-scale value latches can be decreased in comparison with the signal driver 70 in the comparative example, whereby the load of the bus can be decreased. This reduces current consumption accompanied by driving the gray-scale value bus to which the gray-scale value is sequentially supplied.

2.2 First Embodiment

Figure 8:
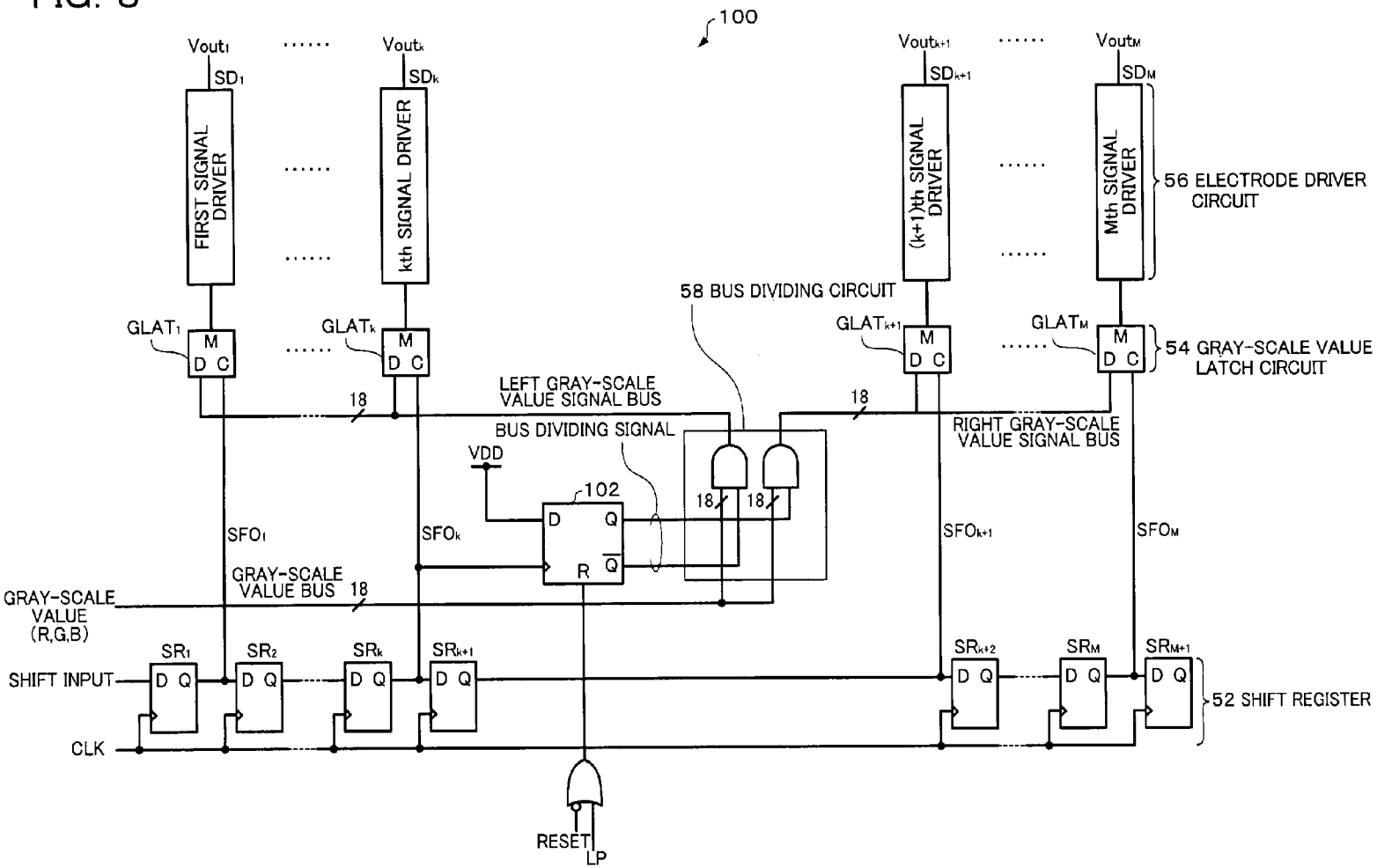
FIG. 8 is a block diagram showing an outline of a configuration of a signal driver in a first embodiment.

FIG. 8 shows a configuration example of a signal driver to which a display driver circuit in a first embodiment is applied.

In FIG. 8, sections the same as those of the signal driver 80 shown in FIG. 6 are indicated by the same symbols. Description of these sections is appropriately omitted.

In a signal driver 100, the bus dividing circuit 58 is formed by using two pieces of two-input, one-output AND circuits. The gray-scale value on the gray-scale value bus is selectively output to either the left gray-scale value signal bus or the right gray-scale value signal bus by using two bus dividing signals generated based on the shift output signal.

The signal driver 100 includes a D-FF 102.

A power supply voltage is supplied to a D terminal of the D-FF 102. The shift output signal $SFO_k$ is input to a C terminal of the D-FF 102. The bus dividing signals are output from a Q terminal and an XQ terminal (reverse of the Q terminal) of the D-FF 102. The bus dividing signals are input to the bus dividing circuit 58. The D-FF 102 is reset when either a negative logic reset signal RESET or a latch pulse signal LP becomes active.

Figure 9:
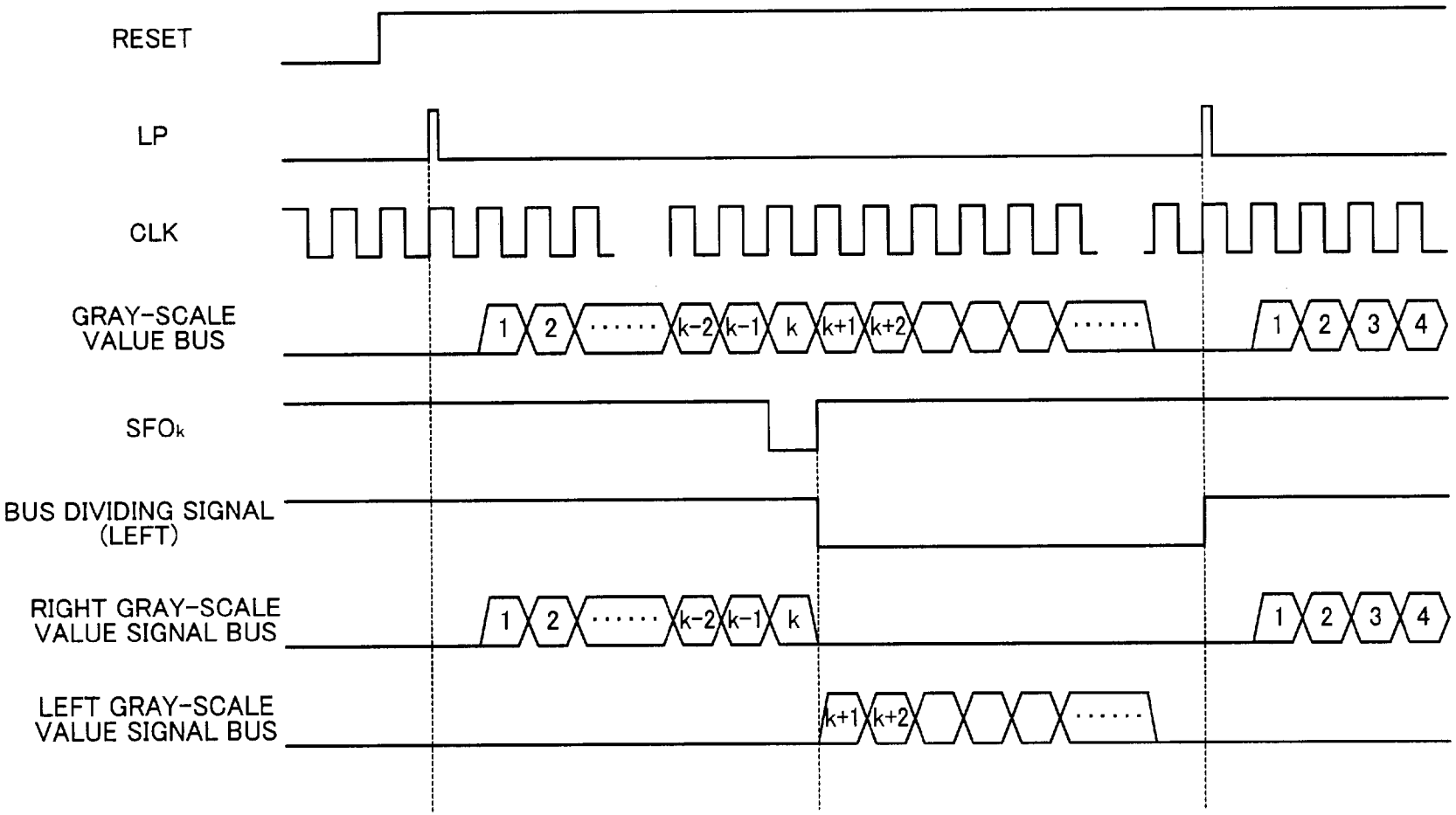
FIG. 9 is a timing chart showing an example of operation timing of the signal driver in the first embodiment.

FIG. 9 shows an example of fetch timing of the gray-scale value of the signal driver 100 in the first embodiment.

When the reset signal RESET is changed from a logic level "L" (active state) to a logic level "H" and the latch pulse signal LP is input, the bus dividing signal at a logic level "L" and the bus dividing signal at a logic level "H" are output to the bus dividing circuit 58 respectively from the Q terminal and the XQ terminal of the D-FF 102. Therefore, the bus dividing circuit 58 outputs the gray-scale value on the gray-scale value bus to the left gray-scale value signal bus and masks the output to the right gray-scale value signal bus to allow a logic level "L" to be output to the right gray-scale value signal bus.

The shift input is sequentially shifted in synchronization with the clock CLK. When a negative logic pulse is output as the shift output signal $SFO_k$, the bus dividing signal at a logic level "H" and the bus dividing signal at a logic level "L" are output to the bus dividing circuit 58 respectively from the Q terminal and the XQ terminal of the D-FF 102 at a rising edge of the shift output signal $SFO_k$. Therefore, the bus dividing circuit 58 outputs the gray-scale value on the gray-scale value bus to the right gray-scale value signal bus and masks the output to the left gray-scale value signal bus to allow a logic level "L" to be output to the left gray-scale value signal bus.

The D-FF 102 is reset when the latch pulse signal LP is input again, and the gray-scale value is fetched in the next scanning cycle.

According to this configuration, the bus dividing signal for decreasing drive current by dividing the bus can be generated by using an extremely simple configuration.

2.3 Second Embodiment

Figure 10:
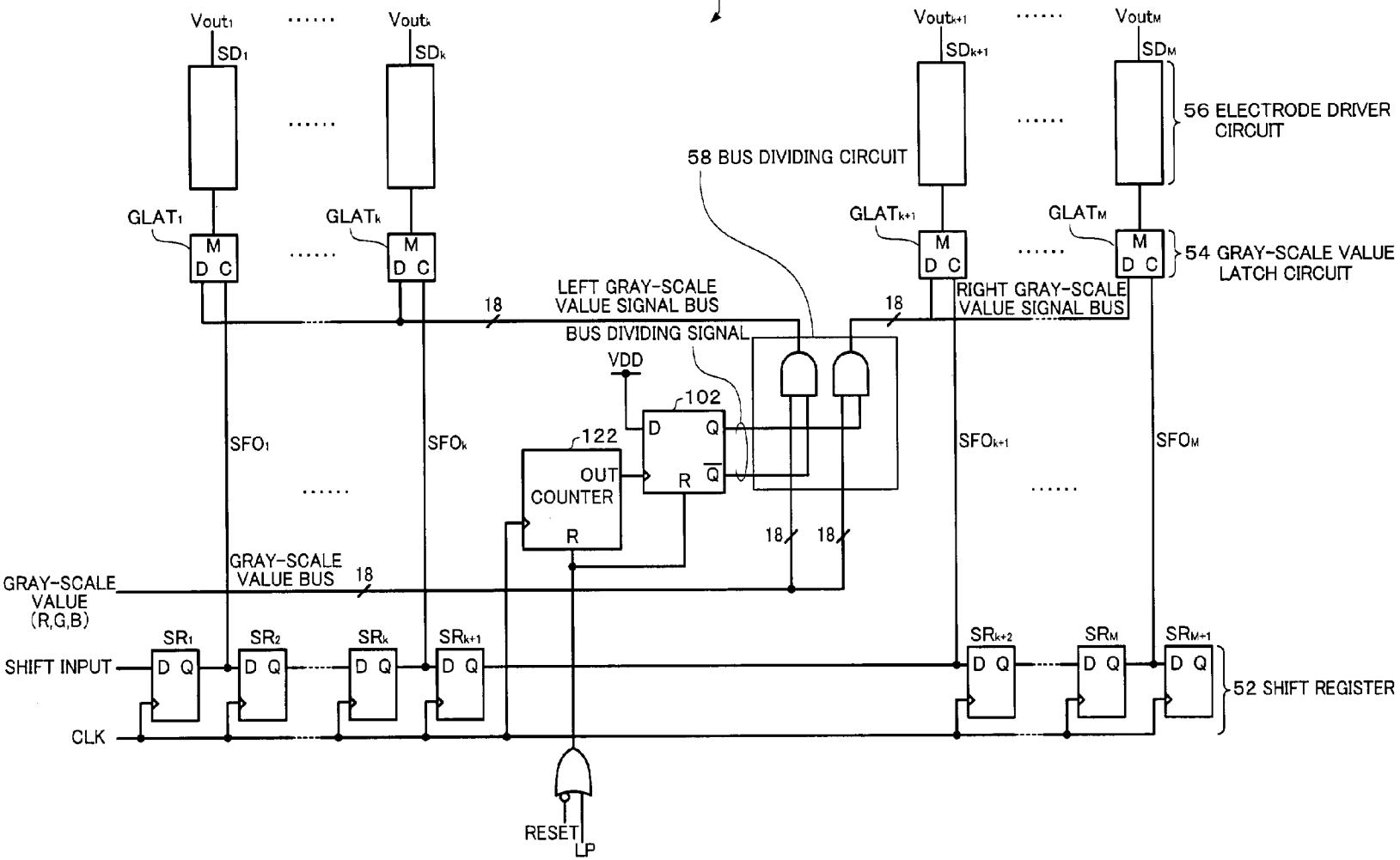
FIG. 10 is a block diagram showing an outline of a configuration of a signal driver in a second embodiment.

FIG. 10 shows a configuration example of a signal driver to which a display driver circuit in a second embodiment is applied.

In FIG. 10, sections the same as those of the signal driver 100 shown in FIG. 8 are indicated by the same symbols. Description of these sections is appropriately omitted.

The feature of a signal driver 120 differing from the signal driver 100 is that a counter output from a counter 122 instead of the shift output signal $SFO_k$ is input to the C terminal of the D-FF 102.

The counter 122 counts up at a rising edge of the clock CLK which specifies the shift timing of the shift register 52, and outputs the counter output at a logic level "H" when the count value reaches a given count value. The count value in the counter 122 is reset at the same timing as the D-FF 102.

Therefore, the signal driver 120 can be operated at the same timing as the timing shown in FIG. 9 by allowing the counter 122 to output the counter output by using the count value corresponding to the output timing of the shift output signal $SFO_k$, for example.

2.4 Third Embodiment

Figure 11:
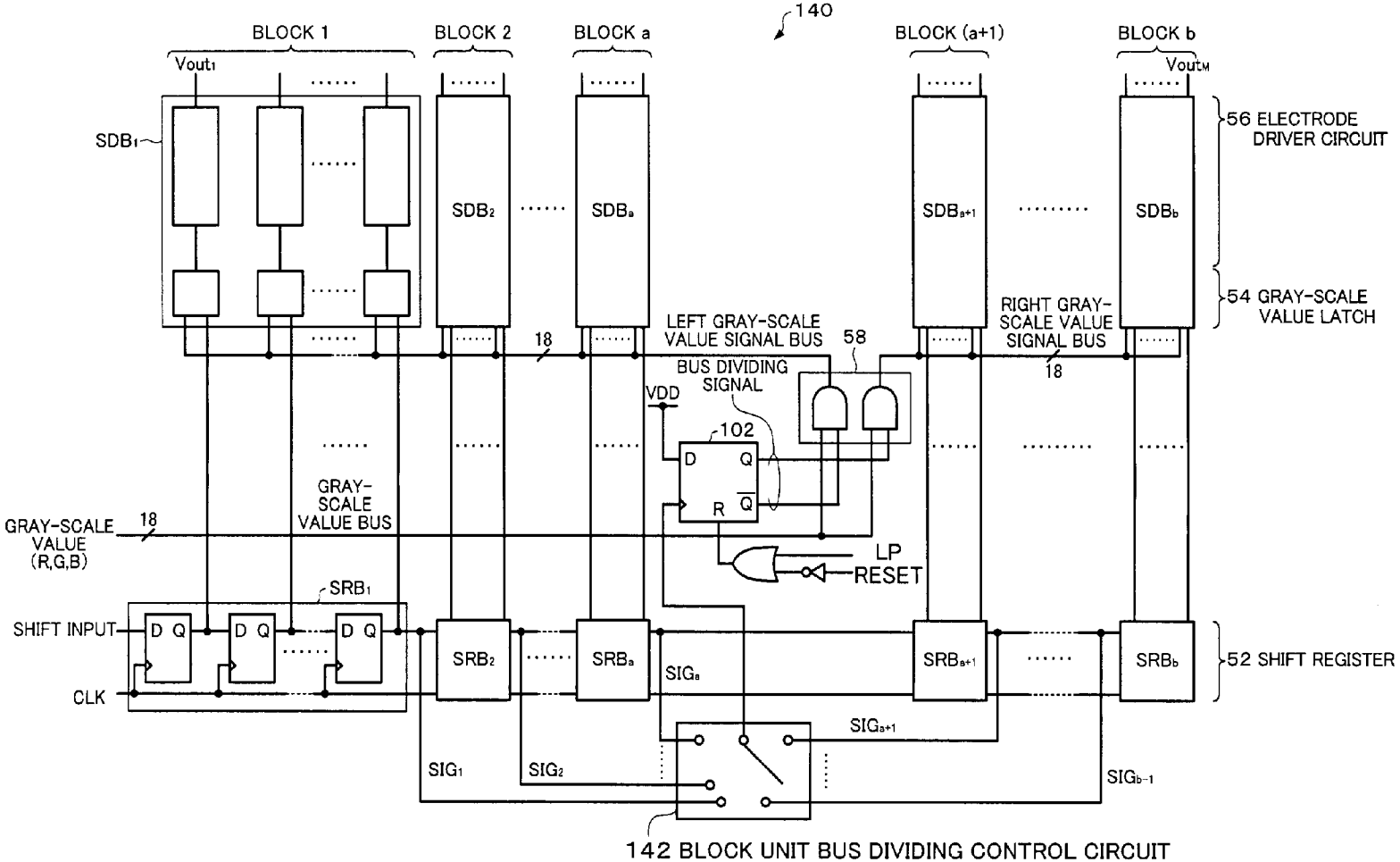
FIG. 11 is a block diagram showing an outline of a configuration of a signal driver in a third embodiment.

FIG. 11 shows a configuration example of a signal driver to which a display driver circuit in a third embodiment is applied.

In FIG. 11, sections the same as those of the signal driver 100 are indicated by the same symbols. Description of these sections is appropriately omitted.

In a signal driver 140, a plurality of flip-flops which make up the shift register 52 are divided into a plurality of shift register blocks $SRB_1$ to $SRB_b$. Block unit shift output signals $SIG_1$ to $SIG_{b-1}$ are respectively output from the shift register blocks $SRB_1$ to $SRB_{b-1}$, and input to a block unit bus dividing control circuit 142.

The block unit bus dividing control circuit 142 is capable of inputting one of the block unit shift output signals $SIG_1$ to $SIG_{b-1}$ to the C terminal of the D-FF 102.

In this configuration, a logic level "L" and a logic level "H" are respectively output from the Q terminal and the XQ terminal of the D-FF 102 as the bus dividing signals in response to the reset signal RESET or the latch pulse signal LP. This allows the bus dividing circuit 58 to output the gray-scale value on the gray-scale value bus to the left gray-scale value signal bus and mask the output to the right gray-scale value signal bus to allow a logic level "L" to be output to the right gray-scale value signal bus.

The block unit bus dividing control circuit 142 inputs one of the block unit shift output signals $SIG_1$ to $SIG_{b-1}$ to the C terminal of the D-FF 102. The D-FF 102 outputs the bus dividing signal at a logic level "L" and the bus dividing signal at a logic level "H" respectively from the Q terminal and the XQ terminal at a rising edge of the block unit shift output signal.

In the case where the block unit bus dividing control circuit 142 outputs the block unit shift output signal $SIG_a$ from the shift register block $SRB_a$ to the C terminal of the D-FF 102, the bus dividing signal is changed at output timing of the block unit shift output signal $SIG_a$. This allows the bus dividing circuit 58 to output the gray-scale value on the gray-scale value bus to the right gray-scale value signal bus instead of the left gray-scale value signal bus after the bus dividing signal is switched.

2.5 Fourth Embodiment

The first to third embodiments illustrate the case where the gray-scale value on the gray-scale value bus is output to either the left gray-scale value signal bus or the right gray-scale value signal bus. However, the present invention is not limited thereto. In a fourth embodiment, a switch margin period (given period) is set when switching the bus to which the bus dividing circuit outputs the gray-scale value on the gray-scale value bus from the left gray-scale value signal bus to the right gray-scale value signal bus. The gray-scale value on the gray-scale value bus is output to both of the left gray-scale value signal bus and the right gray-scale value signal bus in the switch margin period. This prevents unstable operations of signals on the bus and the like accompanied by switching between the left gray-scale value signal bus and the right gray-scale value signal bus. In the display driver circuit, since the kth and (k+1)th gray-scale values are successively supplied to the gray-scale value bus and held in the kth and (k+1)th gray-scale value latches $GLAT_k$ and $GLAT_{k+1}$ based on the shift output signals from the adjacent flip-flops $SR_k$ and $SR_{k+1}$, the effect of setting the switch margin period is significant.

Figure 12:
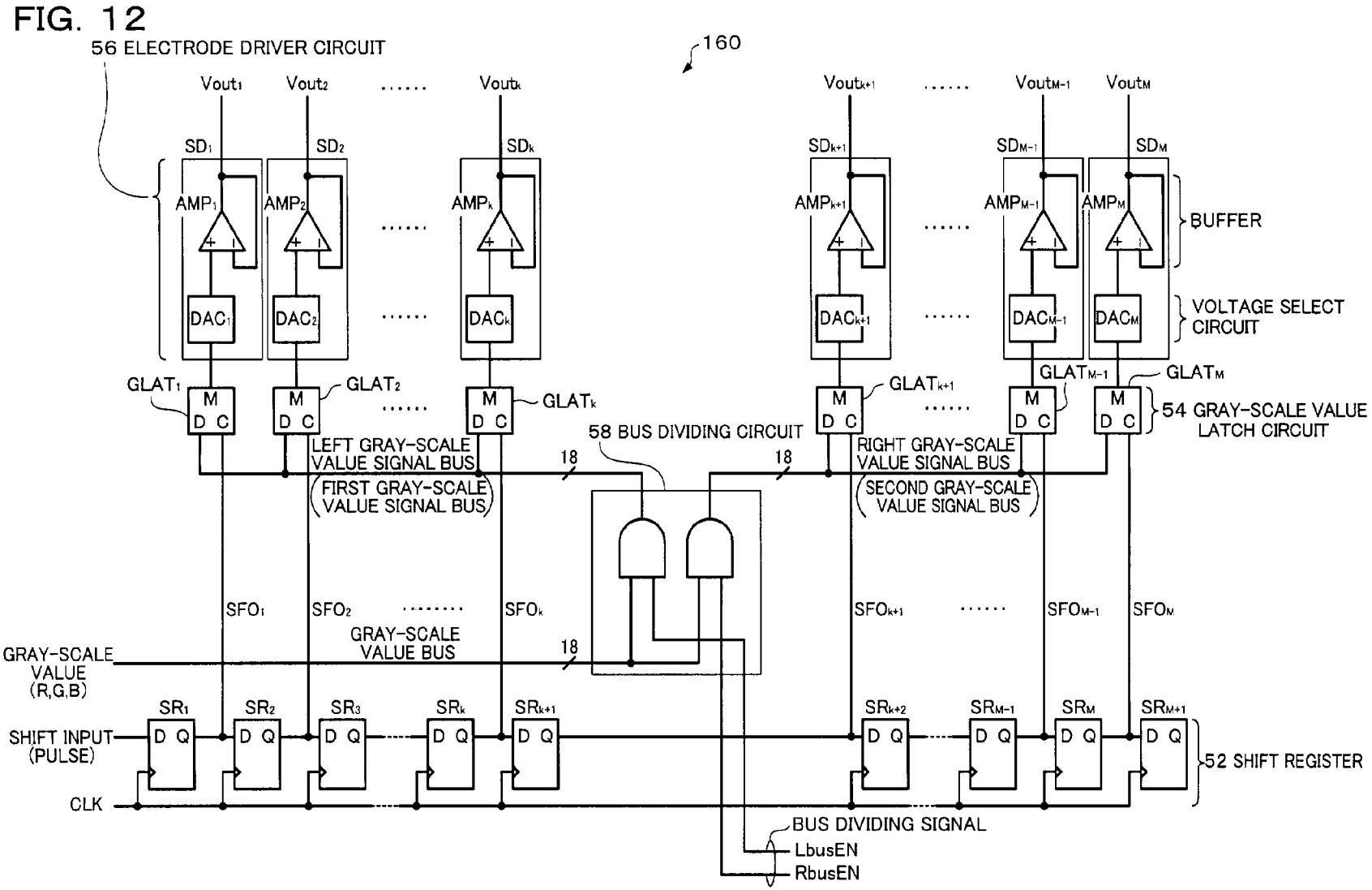
FIG. 12 is a block diagram showing an outline of a configuration of a signal driver in a fourth embodiment.

FIG. 12 shows a configuration example of a signal driver to which a display driver circuit in the fourth embodiment is applied.

In FIG. 12, sections the same as those of the signal driver 100 are indicated by the same symbols. Description of these sections is appropriately omitted.

The feature of a signal driver 160 differing from the signal driver 100 is that the output of the bus dividing circuit 58 is controlled by bus dividing signals LbusEN and RbusEN which are separately changed. The bus dividing circuit 58 outputs the gray-scale value on the gray-scale value bus to the left gray-scale value signal bus when the bus dividing signal LbusEN is at a logic level "H". The bus dividing circuit 58 masks the left gray-scale value signal bus when the bus dividing signal LbusEN is at a logic level "L" to allow a logic level "L" to be output to the left gray-scale value signal bus. The bus dividing circuit 58 outputs the gray-scale value on the gray-scale value bus to the right gray-scale value signal bus when the bus dividing signal RbusEN is at a logic level "H". The bus dividing circuit 58 masks the right gray-scale value signal bus when the bus dividing signal RbusEN is at a logic level "L" to allow a logic level "L" to be output to the right gray-scale value signal bus.

Figure 13:
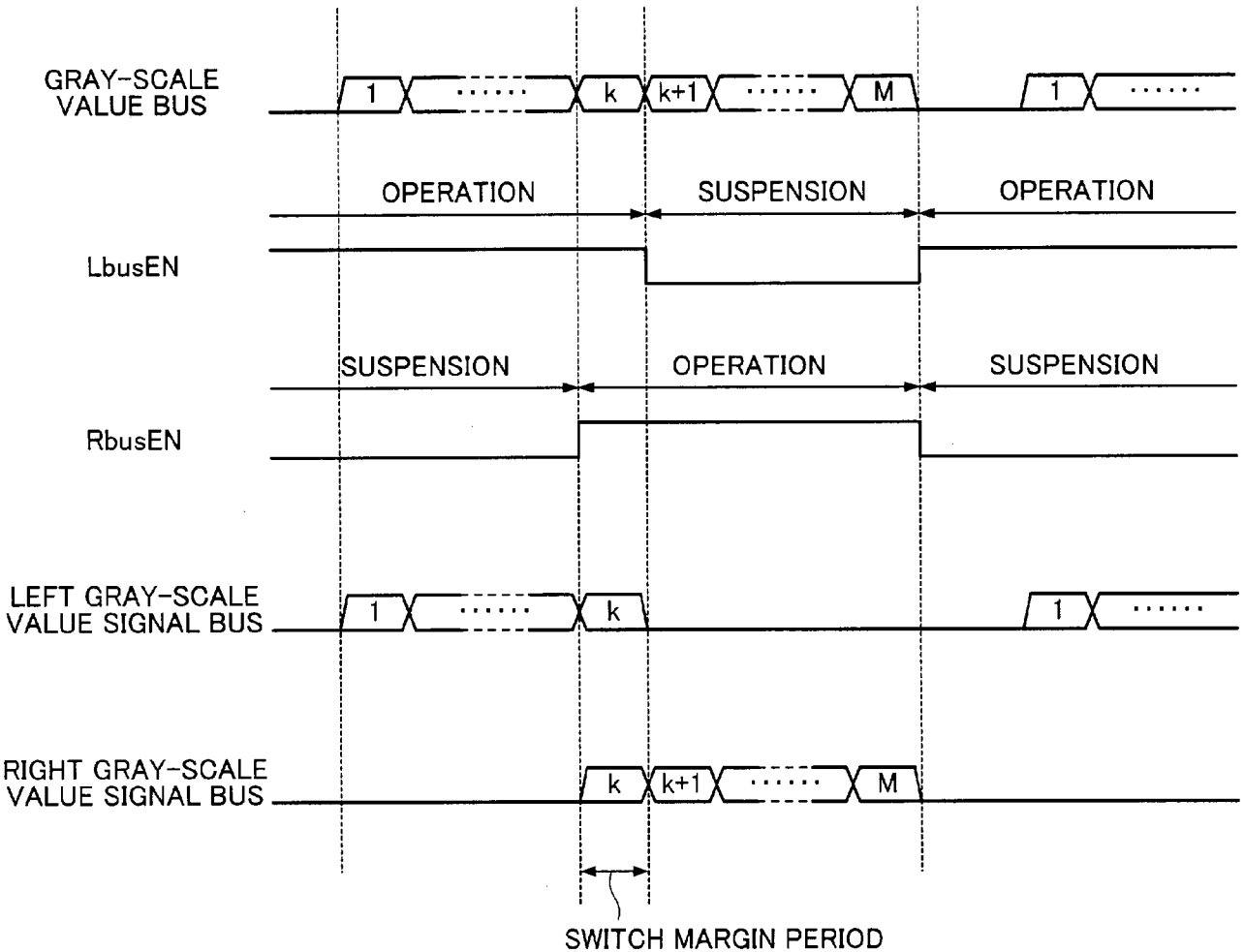
FIG. 13 is a timing chart showing an example of operation timing of the signal driver in the fourth embodiment.

FIG. 13 shows an example of fetch timing of the gray-scale value of the signal driver 160 in the fourth embodiment.

The gray-scale value is sequentially supplied to the gray-scale value bus in response to the clock CLK.

When the bus dividing signal LbusEN is at a logic level "H" and the bus dividing signal RbusEN is at a logic level "L", the gray-scale value on the gray-scale value bus is output to the left gray-scale value signal bus, and the logic level "L" is output to the right gray-scale value signal bus.

When the bus dividing signal LbusEN is at a logic level "H", the switch margin period is set by setting the bus dividing signal RbusEN at a logic level "H" so as to overlap with a period in which the gray-scale value to be held in the kth gray-scale value latch $GLAT_k$ is output to the gray-scale value bus, for example. In the switch margin period, the gray-scale value on the gray-scale value bus is output to both of the left gray-scale value signal bus and the right gray-scale value signal bus. Then, the gray-scale value on the gray-scale value bus is output to only the right gray-scale value signal bus by setting the bus dividing signal LbusEN at a logic level "L".

This enables the load of the gray-scale value bus to be decreased in the same manner as in the first to third embodiments. According to the fourth embodiment, the gray-scale value output to the right gray-scale value signal bus can be latched in a stable state, even if the frequency of the clock CLK of the shift register is increased due to an increase in the number of signal electrodes and the like. Moreover, it is unnecessary to increase drive capability of the circuit which drives the gray-scale value bus.

Figure 14:
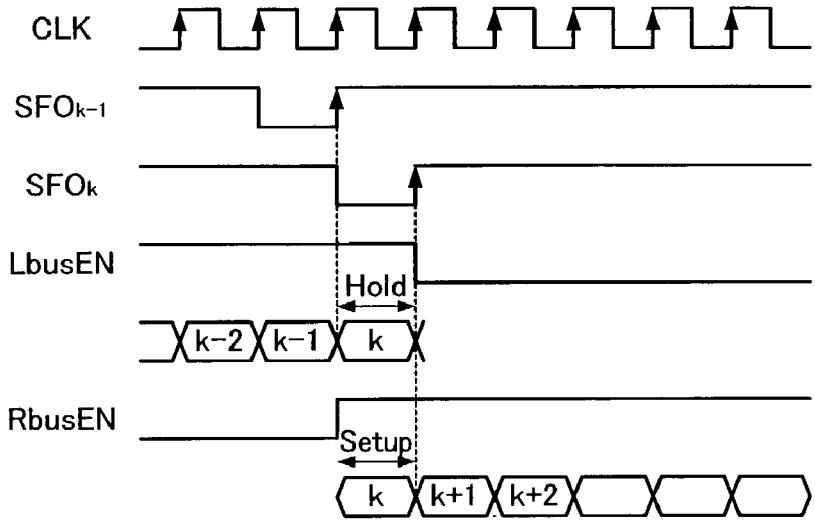
FIG. 14 is an explanatory diagram for describing effects of the signal driver in the fourth embodiment.

As shown in FIG. 14, a hold time can be secured for the (k−1)th gray-scale value latch $GLAT_{k-1}$ which latches the gray-scale value at a rising edge of the shift output signal $SFO_{k-1}$, and a setup time can be secured for the kth gray-scale value latch $GLAT_k$ which latches the gray-scale value at a rising edge of the shift output signal $SFO_k$.

It is preferable that the switch margin period be variable. In the fourth embodiment, the switch margin period can be set by a variable control signal CONTROL.

Figure 15A:
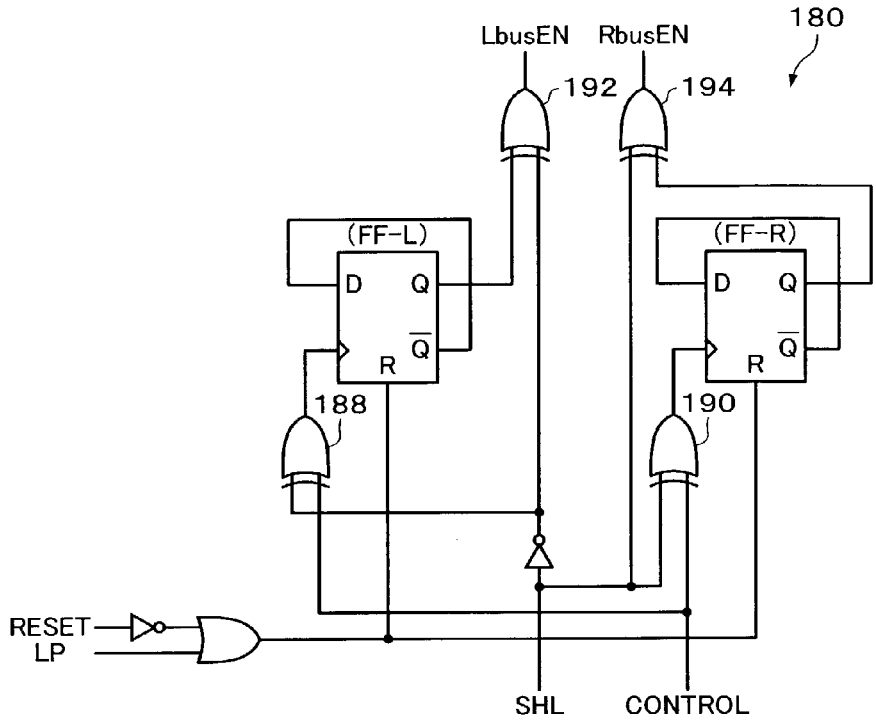
FIG. 15A is a circuit diagram showing an example of a bus dividing signal generating circuit which generates a bus dividing signal in the fourth embodiment.
Figure 15B:
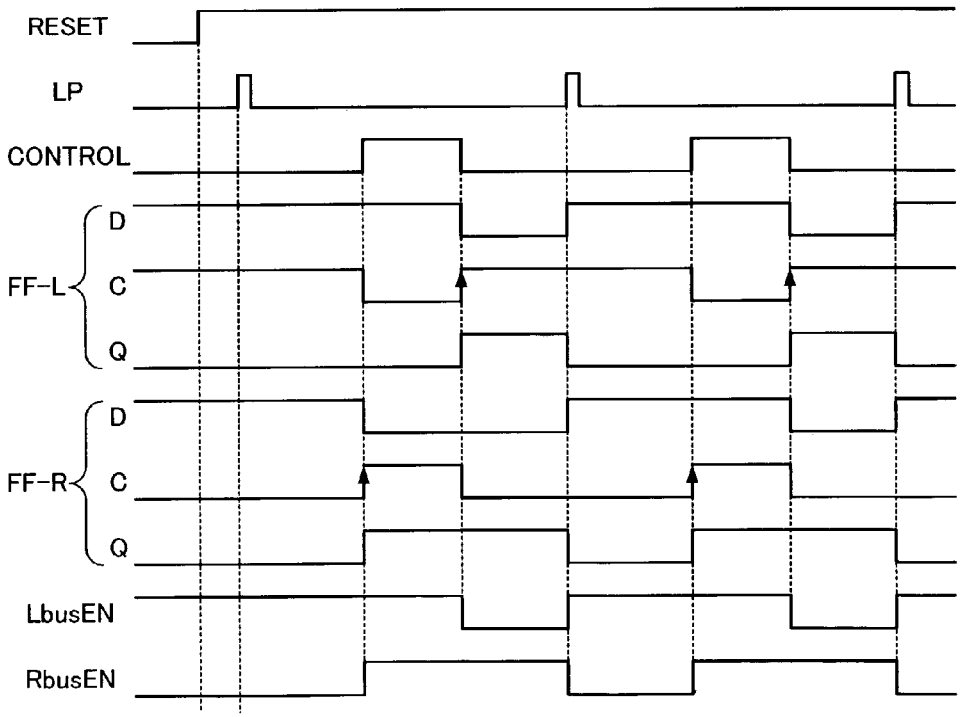
FIG. 15B is a timing chart showing an example of operation timing of the bus dividing signal generating circuit shown in FIG. 15A.

FIG. 15A shows an example of a bus dividing signal generating circuit which generates the bus dividing signals LbusEN and RbusEN in the fourth embodiment. FIG. 15B shows an example of operation timing of the bus dividing signal generating circuit shown in FIG. 15A.

A shift direction control signal SHL for controlling, corresponding to the shift direction of the shift register, and the variable control signal CONTROL are input to the bus dividing signal generating circuit 180. The bus dividing signal generating circuit 180 generates the bus dividing signals LbusEN and RbusEN which become active at the same time during a period set by the variable control signal CONTROL corresponding to the shift direction.

The bus dividing signal generating circuit 180 includes an FF-L and an FF-R which are D-FFs. XQ terminals of the FF-L and FF-R are respectively connected with D terminals of the FF-L and FF-R. A C terminal of the FF-L is connected with an output terminal of an EXOR circuit 188. A C terminal of the FF-R is connected with an output terminal of an EXOR circuit 190.

An inverted signal of the shift direction control signal SHL and the variable control signal CONTROL are input to input terminals of the EXOR circuit 188. The shift direction control signal SHL and the variable control signal CONTROL are input to input terminals of the EXOR circuit 190.

The Q terminal of the FF-L is connected with an input terminal of an EXOR circuit 192. The Q terminal of the FF-R is connected with an input terminal of an EXOR circuit 194. The bus dividing signal LbusEN is output from an output terminal of the EXOR circuit 192. The bus dividing signal RbusEN is output from an output terminal of the EXOR circuit 194.

The inverted signal of the shift direction control signal SHL is input to the other input terminal of the EXOR circuit 192. The shift direction control signal SHL is input to the other input terminal of the EXOR circuit 194.

The FF-L and FF-R are reset when either the reset signal RESET or the latch pulse signal LP becomes active.

The operation of the bus dividing signal generating circuit 180 is described below on the assumption that the shift direction control signal SHL is fixed at a logic level "L" (shift direction is from left to right).

In the bus dividing signal generating circuit 180, the FF-L and FF-R are reset by either the reset signal RESET or the latch pulse signal LP. Therefore, a logic level "H" is input to the D terminals of the FF-L and FF-R. When the variable control signal CONTROL is set at a logic level "H" in a desired period, an inverted signal of the variable control signal CONTROL is output from the output terminal of the EXOR circuit 188. A signal in phase with the variable control signal CONTROL is output from the output terminal of the EXOR circuit 190. Therefore, the FF-R holds the state of the D terminal at a rising edge of the output signal of the EXOR circuit 190 input to the C terminal, and outputs the state of the D terminal from the Q terminal. The bus dividing signal RbusEN which is changed to a logic level "H" is output from the output terminal of the EXOR circuit 194. The FF-L holds the state of the D terminal at a rising edge of the output signal of the EXOR circuit 188 input to the C terminal, and outputs the state of the D terminal from the Q terminal. The bus dividing signal LbusEN which is changed to a logic level "L" is output from the output terminal of the EXOR circuit 192.

The FF-L and the FF-R are reset when the latch pulse signal LP becomes active. This allows the bus dividing signals LbusEN and RbusEN to be returned to the original logic level.

This enables the bus dividing signals LbusEN and RbusEN to be at a logic level "H" during a period in which the variable control signal CONTROL is set at a logic level "H", whereby the switch margin period can be set.

The variable control signal CONTROL input to the bus dividing signal generating circuit 180 may be generated by a variable control signal generating circuit having a configuration described below, for example.

Figure 16A:
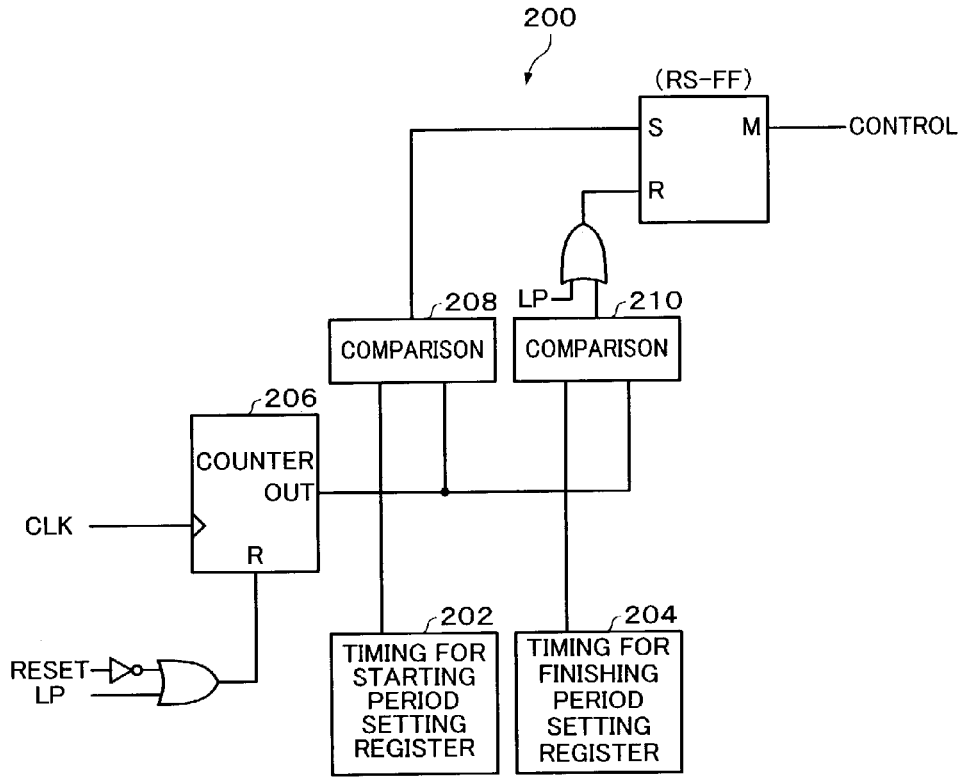
FIG. 16A is a block diagram showing a block configuration example of an outline of a configuration of a variable control signal generating circuit.
Figure 16B:
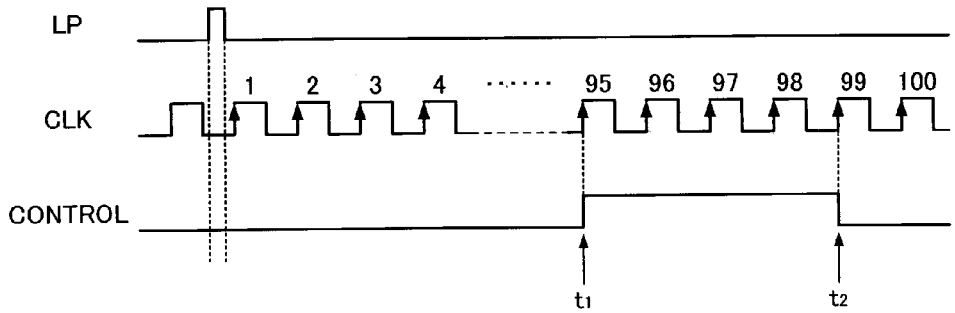
FIG. 16B is a timing chart showing an example of operation timing of the variable control signal generating circuit.

FIG. 16A shows a block configuration example showing an outline of a configuration of the variable control signal generating circuit. FIG. 16B shows an example of operation timing of the variable control signal generating circuit.

A variable control signal generating circuit 200 includes a timing for starting period setting register 202, a timing for finishing period setting register 204, a counter 206, comparison circuits 208 and 210, and a flip-flop RS-FF.

A count value of the counter 206 corresponding to start timing of the switch margin period is set in the timing for starting period setting register 202. A count value of the counter 206 corresponding to finish timing of the switch margin period is set in the timing for finishing period setting register 204.

The counter 206 counts up in synchronization with a rising edge of the clock CLK which specifies the shift timing of the shift register.

The comparison circuit 208 compares the count value set in the timing for starting period setting register 202 with the count value of the counter 206, and generates an output signal which becomes active when these count values coincide. The comparison circuit 210 compares the count value set in the timing for finishing period setting register 204 with the count value of the counter 206, and generates an output signal which becomes active when these count values coincide.

The flip-flop RS-FF outputs an output signal at a logic level "H" as the variable control signal CONTROL from an M terminal when a signal input to an S terminal becomes active. The flip-flop RS-FF outputs an output signal at a logic level "L" as the variable control signal CONTROL from the M terminal when a signal input to an R terminal becomes active. The output signal of the comparison circuit 208 is input to the S terminal of the flip-flop RS-FF. The output signal of the comparison circuit 210 is input to the R terminal of the flip-flop RS-FF.

For example, a count value "95" corresponding to a start timing $t_1$ of the switch margin period is set in the timing for starting period setting register 202, and a count value "99" corresponding to a finish timing $t_2$ Of the switch margin period is set in the timing for finishing period setting register 204. The counter 206 starts to count up in synchronization with the clock CLK after reset by the latch pulse signal LP. When the count value of the counter 206 coincides with the count value "95" set in the timing for starting period setting register 202 in the comparison circuit 208, the variable control signal CONTROL is set at a logic level "H" by the flip-flop RS-FF. The counter 206 continues counting. When the count value of the counter 206 coincides with the count value "99" set in the timing for finishing period setting register 204 in the comparison circuit 210, the variable control signal CONTROL is set at a logic level "L" by the flip-flop RS-FF.

This configuration enables the variable control signal CONTROL, which specifies the switch margin period of which the start timing, the finish timing, and the period of time can be arbitrarily set, to be generated.

2.6 Fifth Embodiment

In a fifth embodiment, the switch margin period can be set in a unit of shift register blocks.

Figure 17:
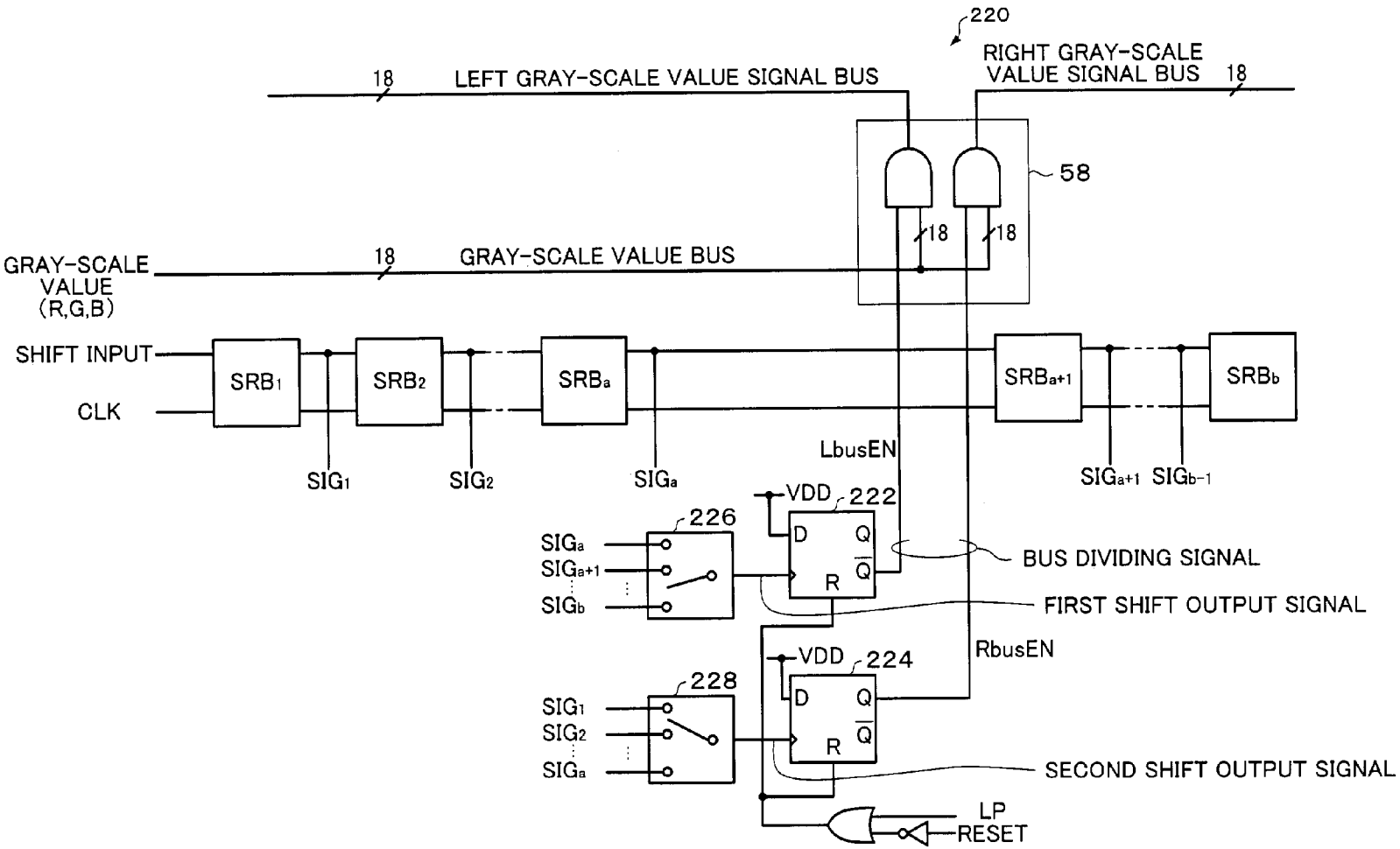
FIG. 17 is a block diagram showing an outline of a configuration of a signal driver in a fifth embodiment.

FIG. 17 shows an example of a feature of a configuration of a signal driver to which a display driver circuit in the fifth embodiment is applied.

In FIG. 17, sections the same as those of the signal driver 140 shown in FIG. 11 are indicated by the same symbols. Description of these sections is appropriately omitted.

The feature of a signal driver 220 differing from the signal driver 140 is that the signal driver 220 includes D-FFs 222 and 224 for generating the bus dividing signals, and switch circuits 226 and 228 which switch the block unit shift output signals input to C terminals of the D-FFs 222 and 224.

Block unit shift output signals $SIG_{a+1}$ to $SIG_b$ are input to the switch circuit 226 from shift register blocks $SRB_{a+1}$ to $SRB_b$, for example. The switch circuit 226 outputs one of the block unit shift output signals $SIG_{a+1}$ to $SIG_b$ (first shift output signal) to the C terminal of the D-FF 222. A D terminal of the D-FF 222 is fixed at a power supply voltage. The D-FF 222 outputs the bus dividing signal LbusEN from an XQ terminal.

Block unit shift output signals $SIG_1$ to $SIG_a$ are input to the switch circuit 228 from the shift register blocks $SRB_1$ to $SRB_a$, for example. The switch circuit 228 outputs one of the block unit shift output signals $SIG_1$ to $SIG_a$ (second shift output signal) to the C terminal of the D-FF 224. A D terminal of the D-FF 224 is fixed at a power supply voltage. The D-FF 224 outputs the bus dividing signal RbusEN from a Q terminal.

The D-FFs 222 and 224 are reset when either the reset signal RESET or the latch pulse signal LP becomes active.

Figure 18:
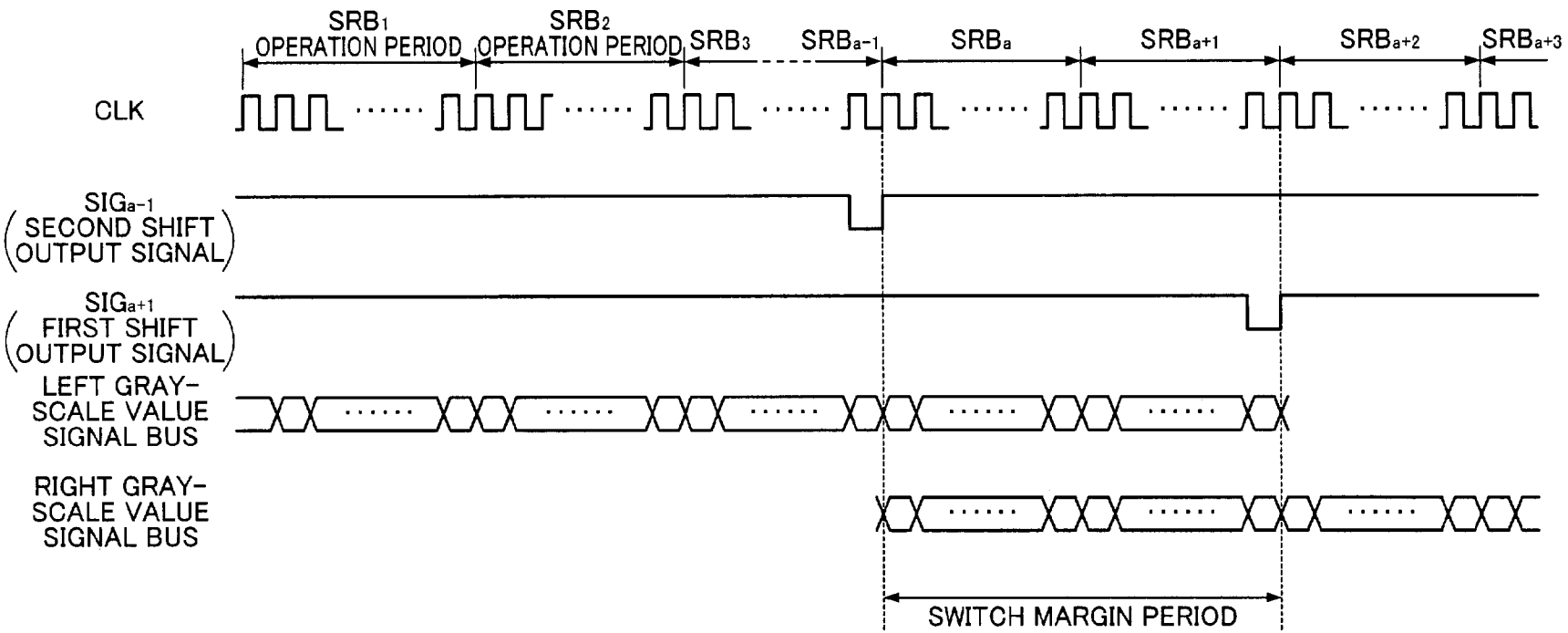
FIG. 18 is a timing chart showing an example of operation timing of the signal driver in the fifth embodiment.

FIG. 18 shows an example of fetch timing of the gray-scale value of the signal driver 220 in the fifth embodiment.

In this example, switch control is performed by the switch circuit 226 so that the block unit shift output signal $SIG_{a+1}$ is input to the C terminal of the D-FF 222. Switch control is also performed by the switch circuit 228 so that the block unit shift output signal $SIG_{a-1}$ is input to the C terminal of the D-FF 224.

In this case, the D-FF 222 is reset by the latch pulse signal LP. Since the bus dividing signal LbusEN is at a logic level "H" until the block unit shift output signal $SIG_{a+1}$ is output from the shift register block $SRB_{a+1}$, the bus dividing circuit 58 outputs the gray-scale value on the gray-scale value bus to the left gray-scale value signal bus.

The block unit shift output signal $SIG_{a-1}$ is output from the shift register block $SRB_{a-1}$ before the block unit shift output signal $SIG_{a+1}$ is output from the shift register block $SRB_{a+1}$. Therefore, the logic level of the bus dividing signal RbusEN is switched from "L" to "H" by the block unit shift output signal $SIG_{a-1}$, whereby the gray-scale value on the gray-scale value bus is output to the right gray-scale value signal bus.

This allows the gray-scale value on the gray-scale value bus to be output to both of the left gray-scale value signal bus and the right gray-scale value signal bus in the switch margin period until the block unit shift output signal $SIG_{a+1}$ is output after the block unit shift output signal $SIG_{a-1}$ is output.

2.7 Sixth Embodiment

In a sixth embodiment, a display driver circuit is applied to a signal driver which performs a partial operation. In the partial operation, current consumption accompanied by unnecessarily driving electrodes is reduced by performing eight color display by using only the most significant bits of each color of the gray-scale value consisting of six bits each for RGB. A signal driver which performs such a partial operation includes a partial operation register (PART register) which selects whether or not to allow the partial operation in a unit of a plurality of blocks into which the first to Mth signal electrodes are divided.

The signal driver in the sixth embodiment includes the shift register 52, the gray-scale value latch circuit 54, the bus dividing circuit, the partial operation register, and first to Mth signal electrode driver circuits which are provided corresponding to the first to Mth signal electrodes and drive the first to Mth signal electrodes based on the gray-scale values held in the first to Mth gray-scale value latches.

The ith ($1 \leqq i \leqq M$, i is an integer) signal electrode driver circuit drives the ith signal electrode by using the most significant bits of each color of the gray-scale value held in the ith gray-scale value latch in the case where the ith signal electrode driver circuit belongs to a block specified by the partial operation register as a block in which the partial operation is performed. The ith signal electrode driver circuit drives the ith signal electrode based on the gray-scale value held in the ith gray-scale value latch in the case where the ith signal electrode driver circuit belongs to a block specified by the partial operation register as a block in which the partial operation is not performed.

The bus dividing circuit outputs only the most significant bits of each color of the gray-scale value corresponding to the block specified by the partial operation register as a block in which the partial operation is performed, to either or both of the left and right gray-scale value signal buses.

Figure 19:
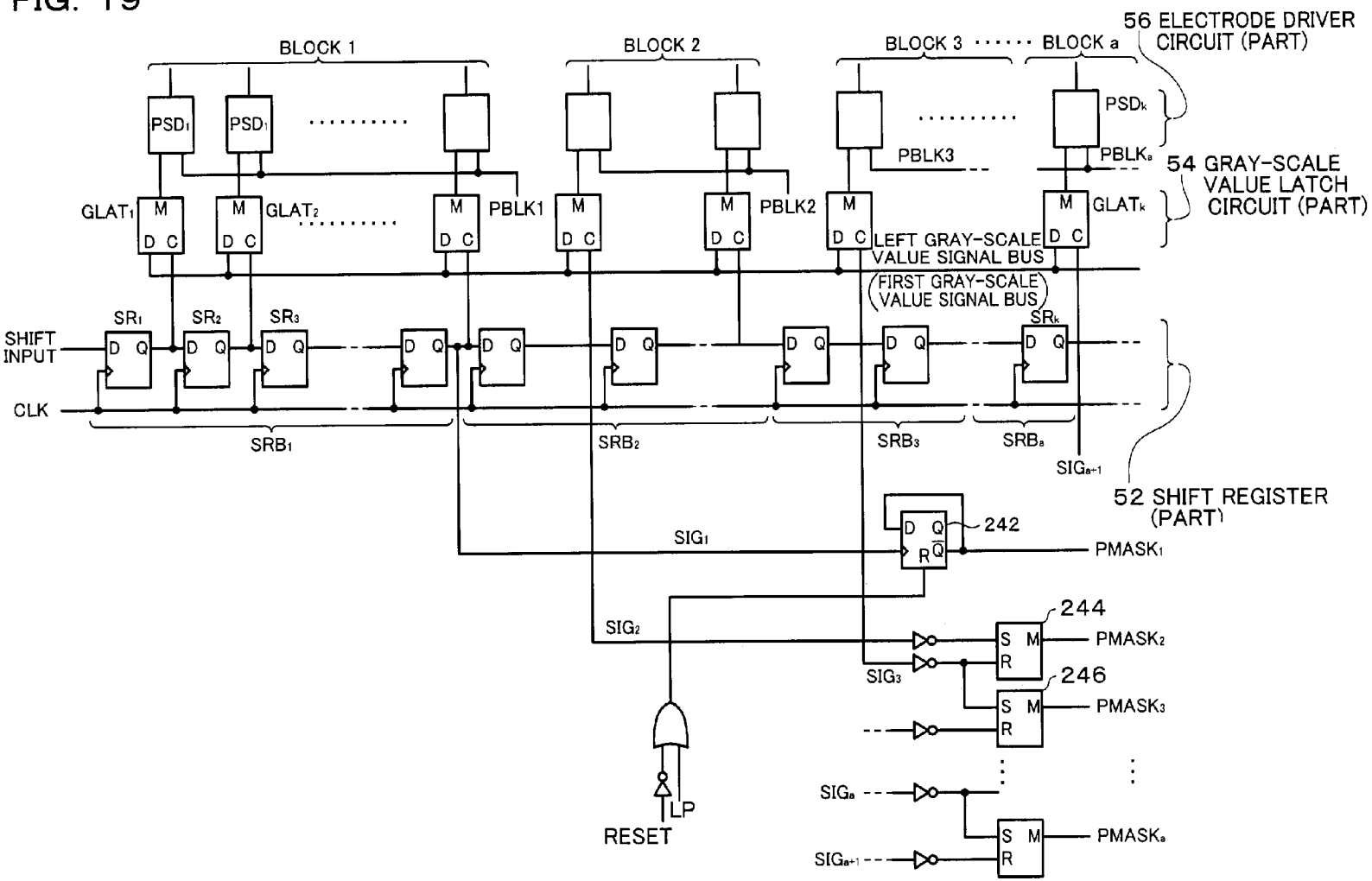
FIG. 19 is a block diagram showing an outline of a configuration of a signal driver in a sixth embodiment.
Figure 20:
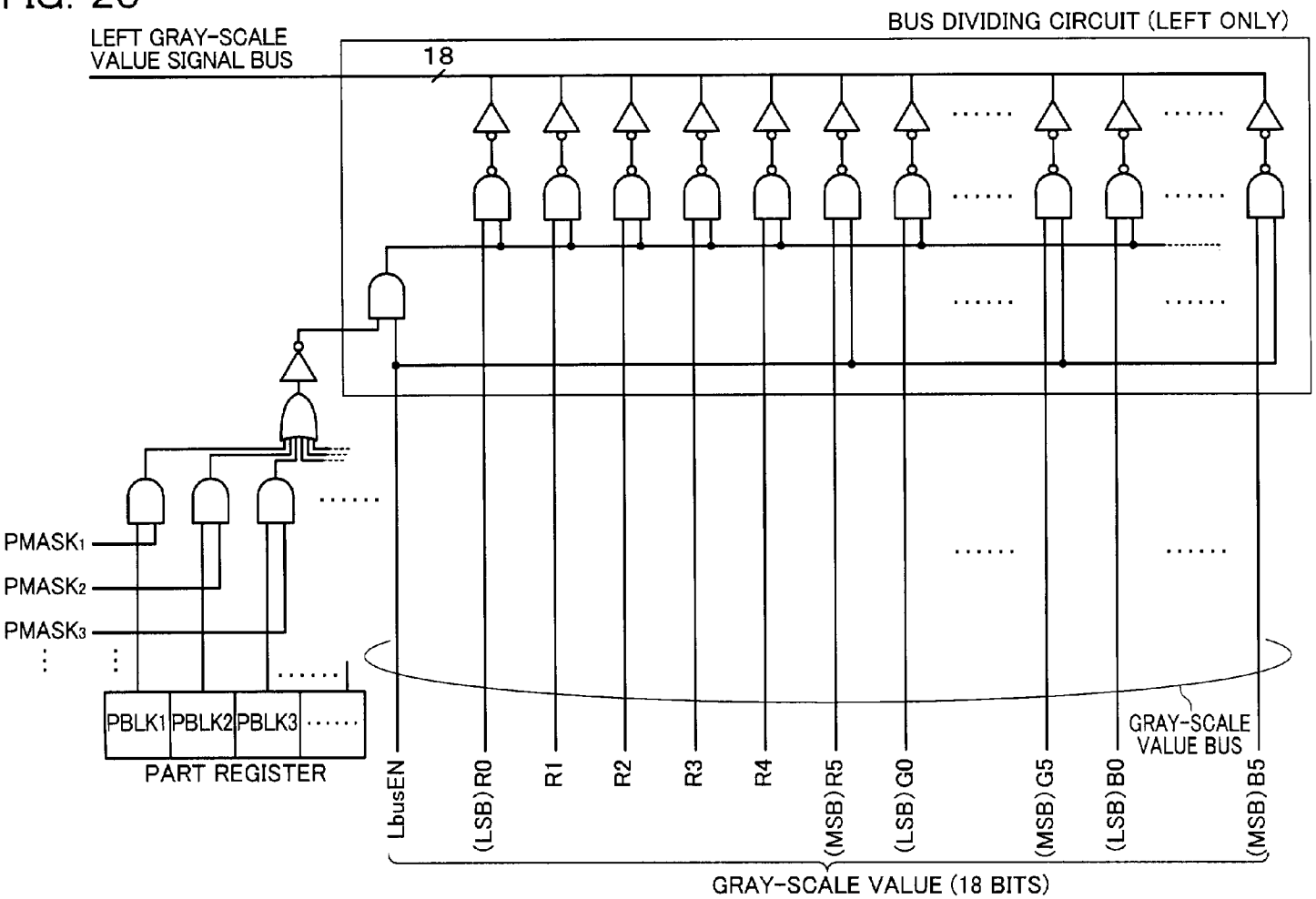
FIG. 20 is a block diagram showing an outline of a configuration of the signal driver in the sixth embodiment.

FIGS. 19 and 20 show an example of a feature of a configuration of a signal driver to which a display driver circuit in the sixth embodiment is applied.

In FIGS. 19 and 20, only the left gray-scale value signal bus is illustrated. However, the right gray-scale value signal bus may have the same configuration as the left gray-scale value signal bus.

In a signal driver 240, a plurality of flip-flops which make up the shift register 52 are divided into a plurality of blocks. Specifically, the shift register 52 is made up of the shift register blocks $SRB_1$ to $SRB_b$. FIG. 19 illustrates only the shift register blocks $SRB_1$ to $SRB_a$ on the side of the left gray-scale value signal bus.

The block unit shift output signal $SIG_1$ is output from a Q terminal of the flip-flop at the final stage of the flip-flops which make up the shift register block $SRB_1$. The block unit shift output signals $SIG_2$ to $SIG_b$ are output from Q terminals of the flip-flops at the first stage of the flip-flops which make up the shift register blocks $SRB_2$ to $SRB_b$.

The shift output signal from the shift register 52 is input to the gray-scale value latch, whereby the gray-scale value on the left gray-scale value signal bus is fetched by the gray-scale value latch. The signal electrode is driven by a partial operation signal electrode driver circuit PSD which makes up the electrode driver circuit 56 by using the gray-scale value held in the gray-scale value latch.

As shown in FIG. 19, the block unit shift output signal $SIG_1$ is input to a C terminal of a D-FF 242 of which an XQ terminal is connected with a D terminal. A mask signal $PMASK_1$ is output from the XQ terminal of the D-FF 242.

An inverted signal of the block unit shift output signal $SIG_2$ is input to an S terminal of an RS-FF 244. An inverted signal of the block unit shift output signal $SIG_3$ is input to an R terminal of the RS-FF 244. The RS-FF 244 sets the signal output from the M terminal at a logic level "H" when the signal input to the S terminal becomes active. The RS-FF 244 sets the signal output from the M terminal at a logic level "L" when the signal input to the R terminal becomes active. A mask signal $PMASK_2$ is output from the M terminal of the RS-FF 244.

An inverted signal of the block unit shift output signal $SIG_3$ is input to an S terminal of an RS-FF 246. An inverted signal of the block unit shift output signal $SIG_4$ is input to an R terminal of the RS-FF 246. The RS-FF 246 sets the signal output from the M terminal at a logic level "H" when the signal input to the S terminal becomes active. The RS-FF 244 sets the signal output from the M terminal at a logic level "L" when the signal input to the R terminal becomes active. A mask signal $PMASK_3$ is output from the M terminal of the RS-FF 246.

The mask signal is generated in this manner in a unit of blocks in which the partial operation is performed. As shown in FIG. 20, when the bus dividing signal LbusEN is at a logic level "H", only the most significant bits of each color of the gray-scale value consisting of six bits each for RGB (18 bits in total) are output to the left gray-scale value signal bus. A logic level "L" is output for the lower order bits of each color.

The gray-scale value output to the left gray-scale value signal bus is held in the gray-scale value latch based on the shift output signal from the shift register 52. The partial operation signal electrode driver circuit PSD drives the signal electrode based on the gray-scale value held in the gray-scale value latch.

The partial operation signal electrode driver circuit PSD is provided for each signal electrode. A partial operation signal PBLK which indicates whether or not to allow the partial operation for each block is input to the partial operation signal electrode driver circuit PSD. The partial operation signal electrode driver circuit PSD drives the signal electrode by using only the most significant bits of each color when specified by the partial operation signal PBLK as a block in which the partial operation is performed.

Figure 21:
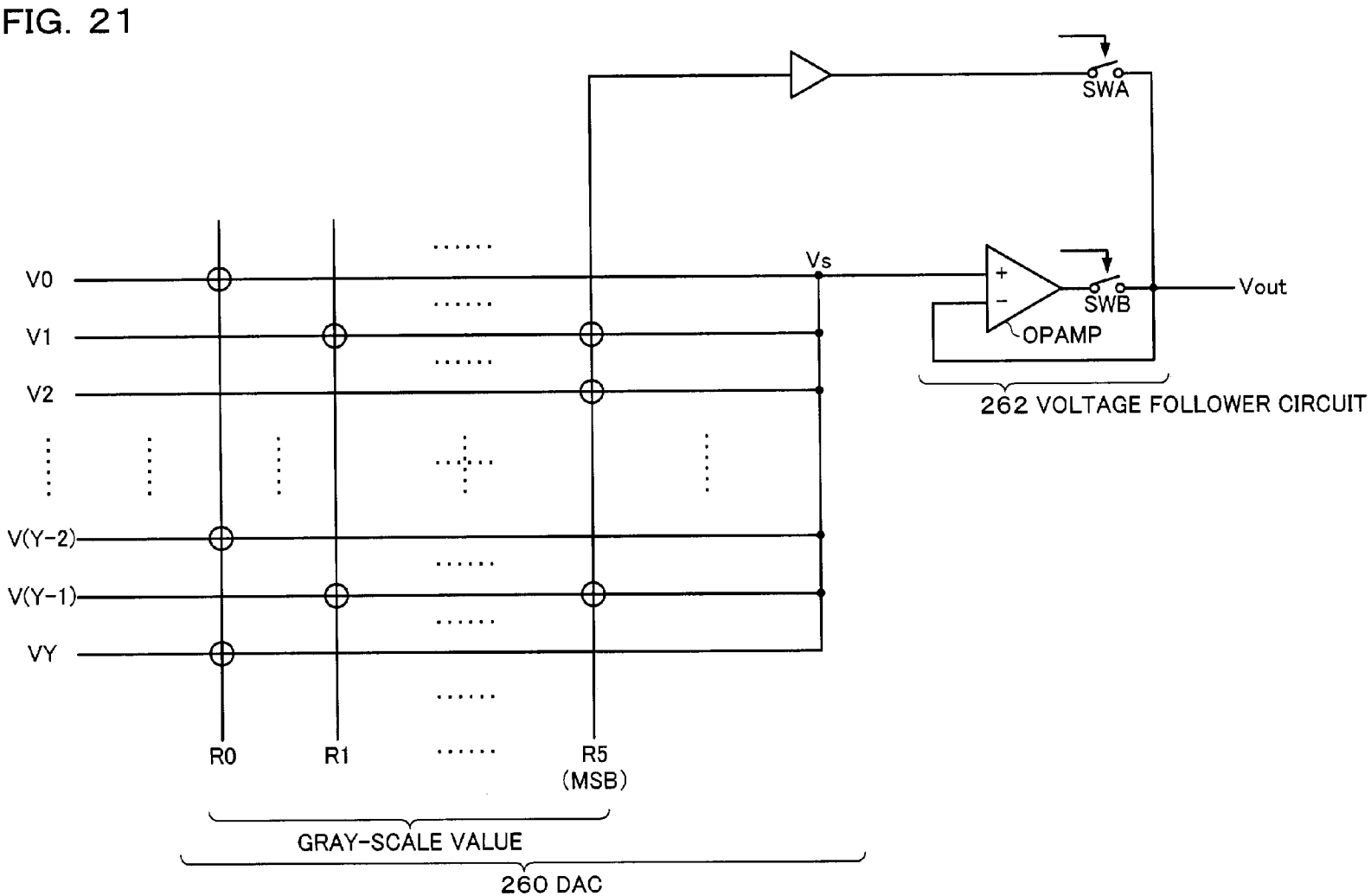
FIG. 21 is a configuration diagram showing an example of a configuration of a partial operation signal electrode driver circuit in the sixth embodiment.

FIG. 21 shows an example of a configuration of the partial operation signal electrode driver circuit.

FIG. 21 shows only the configuration for one output.

The partial operation signal electrode driver circuit PSD includes a DAC 260, a voltage follower circuit 262, and switch circuits SWA and SWB. One of the switch circuits SWA and SWB is turned ON in response to the partial operation signal PBLK, whereby the drive voltage Vout is output to the signal electrode.

When specified by the partial operation signal PBLK as a block in which the partial operation is performed, the switch circuit SWA is turned ON, and the switch circuit SWB is turned OFF. The signal electrode is driven by using the most significant bit R5 of the 6-bit R signal. In this case, since no operational amplifier is used to drive the signal electrode, current consumption can be significantly reduced.

When specified by the partial operation signal PBLK as a block in which the partial operation is not performed, the switch circuit SWA is turned OFF and the switch circuit SWB is turned ON. The DAC 260 decodes the six bits of signals R5 to R0 and generates a select voltage Vs selected from a plurality of the reference voltages VY to V0. The voltage follower circuit 262 drives the signal electrode by using the select voltage Vs. In this case, since an operational amplifier is used to drive the signal electrode, sufficient drive capability can be obtained by performing impedance conversion.

Since it is unnecessary to output the lower order bits of the gray-scale value to the left gray-scale value signal bus by realizing a signal driver having the configuration shown in FIGS. 19, 20, and 21, drive current can be reduced. Therefore, current consumption can be further reduced.

2.8 Seventh Embodiment

In the first to sixth embodiments, the gray-scale value bus to which the gray-scale value is supplied is divided by using the bus dividing signal. However, the present invention is not limited thereto. In a seventh embodiment, a clock bus to which the clock CLK is supplied is divided by using a clock bus dividing signal.

Generally, since the flip-flops which make up the shift register are disposed in the direction in which the signal electrodes are arranged, the interconnect length of the clock bus connected with the C terminals of each flip-flop is increased. Therefore, power consumption accompanied by driving the clock bus is reduced by dividing the clock bus so that the clock CLK is supplied to only necessary flip-flops.

Figure 22:
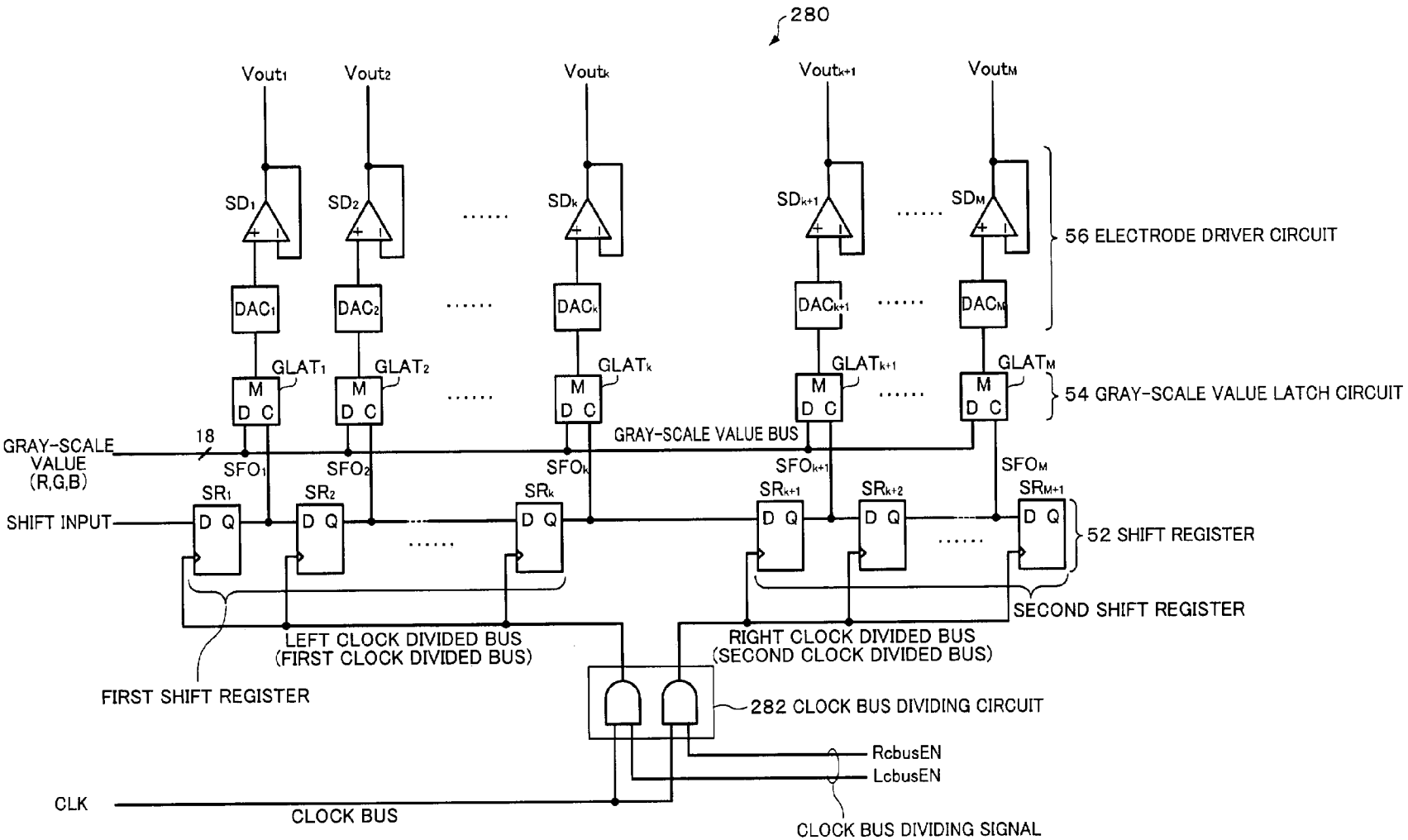
FIG. 22 is a block diagram showing an outline of a configuration of a signal driver in a seventh embodiment.

FIG. 22 shows a configuration example of a signal driver to which a display driver circuit in the seventh embodiment is applied.

In FIG. 22, sections the same as those of the signal driver 70 in the comparative example shown in FIG. 4 are indicated by the same symbols. Description of these sections is appropriately omitted.

In a signal driver 280, the shift register 52 includes first and second shift registers. The first shift register is made up of flip-flops $SR_1$ to $SR_k$ among flip-flops $SR_1$ to $SR_{M+1}$. The second shift register is made up of flip-flops $SR_{k+1}$ to $SR_{M+1}$ among the flip-flops $SR_1$ to $SR_{M+1}$.

A left clock divided bus (first clock divided bus) is connected in common with C terminals of the flip-flops which make up the first shift register. A right clock divided bus (second clock divided bus) is connected in common with C terminals of the flip-flops which make up the second shift register.

The clock bus dividing circuit 282 outputs the clock CLK supplied to the clock bus to either or both of the left and right clock divided buses.

The gray-scale value is sequentially supplied to the gray-scale value bus in response to the clock CLK. The first to Mth gray-scale value latches $GLAT_1$ to $GLAT_M$ fetch the gray-scale value on the gray-scale value bus based on the shift output signals $SFO_1$ to $SFO_M$ output from the flip-flops $SR_1$ to $SR_M$ which make up the first and second shift registers.

The first to Mth signal driver circuits $SD_1$ to $SD_M$ output the drive voltages based on the gray-scale values held in the first to Mth gray-scale value latches $GLAT_1$ to $GLAT_M$ to the corresponding signal electrodes.

The gray-scale value bus maybe divided in the same manner as in the first to sixth embodiments.

Figure 23:
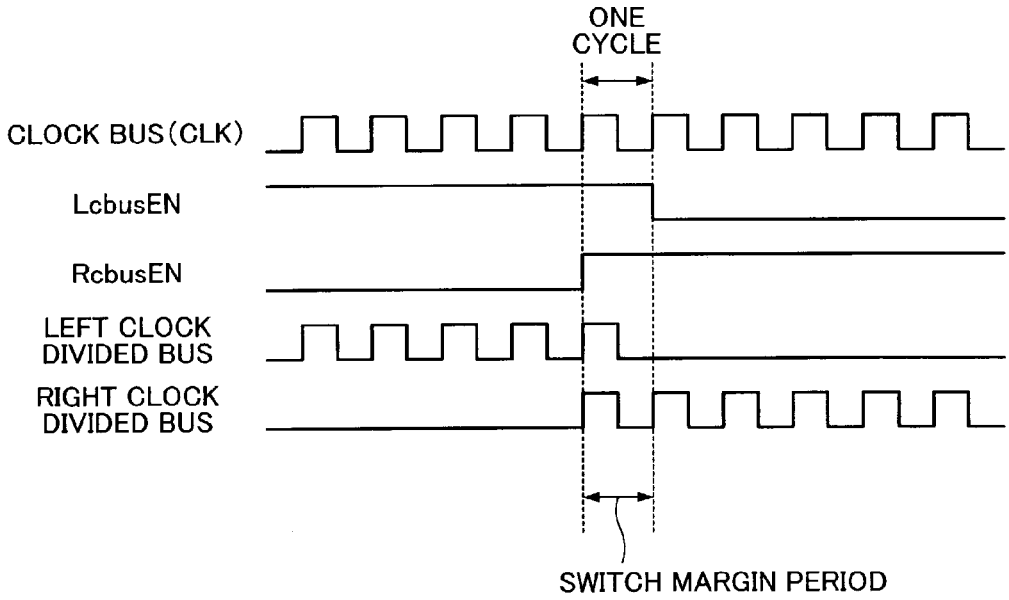
FIG. 23 is a timing chart showing an example of operation timing of the signal driver in the seventh embodiment.

FIG. 23 shows an example of operation timing of the signal driver 280 in the seventh embodiment.

When the clock bus dividing signal LcbusEN is at a logic level "H", the clock CLK supplied to the clock bus is output to the left clock divided bus. When the clock bus dividing signal LcbusEN is at a logic level "L", the left clock divided bus is fixed at a logic level "L".

When the clock bus dividing signal RcbusEN is at a logic level "H", the clock CLK supplied to the clock bus is output to the right clock divided bus. When the clock bus dividing signal RcbusEN is at a logic level "L", the right clock divided bus is fixed at a logic level "L".

It is preferable to provide a switch margin period in the same manner as described above in order to supply the clock CLK in common to each flip-flop which makes up the shift register 52. In this case, a period in which both of the clock bus dividing signals LcbusEN and RcbusEN are at a logic level "H" is provided for at least equal to or more than one cycle of the clock CLK. This prevents unstable operations accompanied by bus switching.

2.9 Eighth Embodiment

In the first to seventh embodiments, the display driver circuit is applied to a signal driver which drives the signal electrodes of the liquid crystal panel. However, the present invention is not limited thereto. In an eighth embodiment, a display driver circuit is applied to a scan driver which drives scan electrodes of the liquid crystal panel.

Figure 24:
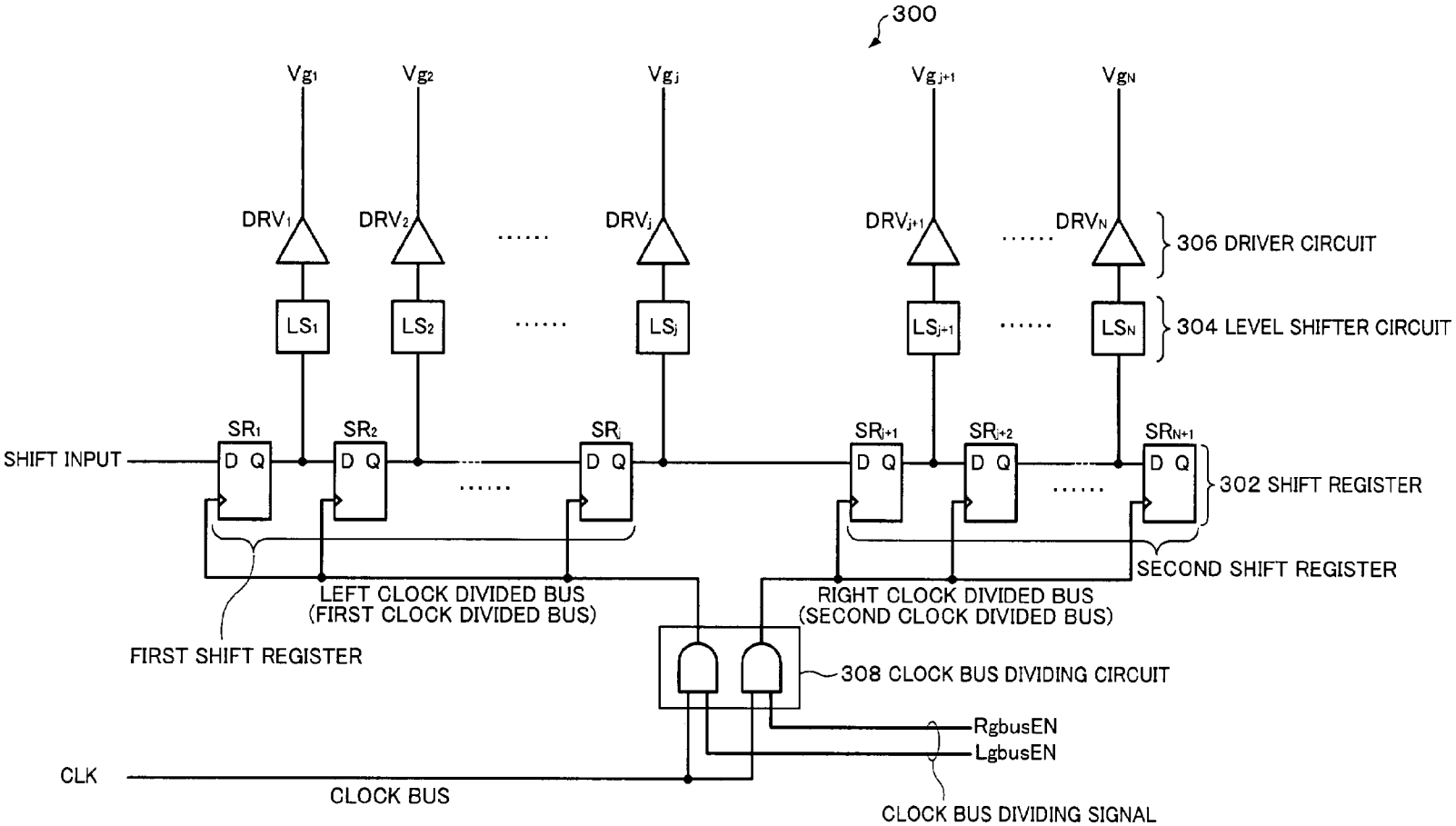
FIG. 24 is a block diagram showing an outline of a configuration of a scan driver in an eighth embodiment.

FIG. 24 shows a configuration example of a scan driver to which a display driver circuit in the eighth embodiment is applied.

A scan driver 300 includes a shift register 302, a level shifter circuit 304, a driver circuit 306, and a clock bus dividing circuit 308.

In the shift register 302, flip-flops $SR_1$ to $SR_N$ provided corresponding to the first to Nth scan electrodes $G_1$ to $G_N$ are connected in series with the flip-flop $SR_{N+1}$. A left clock divided bus (first clock divided bus) is connected with C terminals of the flip-flops $SR_1$ to $SR_j$ ($1 \leqq j < N$, j is an integer) which make up the first shift register. A right clock divided bus (second clock divided bus) is connected with C terminals of the flip-flops $SR_{j+1}$ to $SR_{N+1}$ which make up the second shift register. Shift output signals from the flip-flops $SR_1$ to $SR_N$ are output to the level shifter circuit 304.

The level shifter circuit 304 includes level shifters $LS_1$ to $LS_N$ provided corresponding to the first to Nth scan electrodes $G_1$ to $G_N$. The level shifters $LS_1$ to $LS_N$ convert the voltage levels of the shift output signals from the flip-flops $SR_1$ to $SR_N$ to given voltage levels corresponding to the logic levels of the shift output signals from the flip-flops $SR_1$ to $SR_N$.

The driver circuit 306 includes drivers $DRV_1$ to $DRV_N$ provided corresponding to the first to Nth scan electrodes $G_1$ to $G_N$. The drivers $DRV_1$ to $DRV_N$ drive the first to Nth scan electrodes $G_1$ to $G_N$ by using the signals level-shifted by the level shifters $LS_1$ to $LS_N$.

The clock bus dividing circuit 308 outputs the clock CLK supplied to the clock bus to either or both of the left and right clock divided buses based on clock bus dividing signals LgbusEN and RgbusEN.

In the scan driver having the above configuration, a shift input input to the D terminal of the flip-flop $SR_1$ in each vertical scanning period is sequentially shifted by the shift register 302. The first to Nth scan electrodes $G_1$ to $G_N$ are sequentially driven by using the shift output signals from the flip-flops which make up the shift register 302.

It is preferable to provide a switch margin period in the same manner as described above in order to supply the clock CLK in common to each flip-flop which makes up the shift register 302. In this case, a period in which both of the clock bus dividing signals LgbusEN and RgbusEN are at a logic level "H" is provided for at least equal to or more than one cycle of the clock CLK. This prevents unstable operations accompanied by switching the clock bus.

This configuration reduces the load of the clock bus connected in common with each flip-flop which makes up the shift register 302, generally disposed in the direction in which the scan electrodes are arranged, whereby current consumption can be reduced.

The present invention is not limited to the above-described embodiments. Various modifications and variations are possible within the spirit and scope of the present invention.

The first to eighth embodiments illustrate the case where the gray-scale value bus or the clock bus is divided into two sections. However, the present invention is not limited thereto. The present invention may be applied to the case where the gray-scale value bus or the clock bus is divided into three or more sections.

Figure 25:
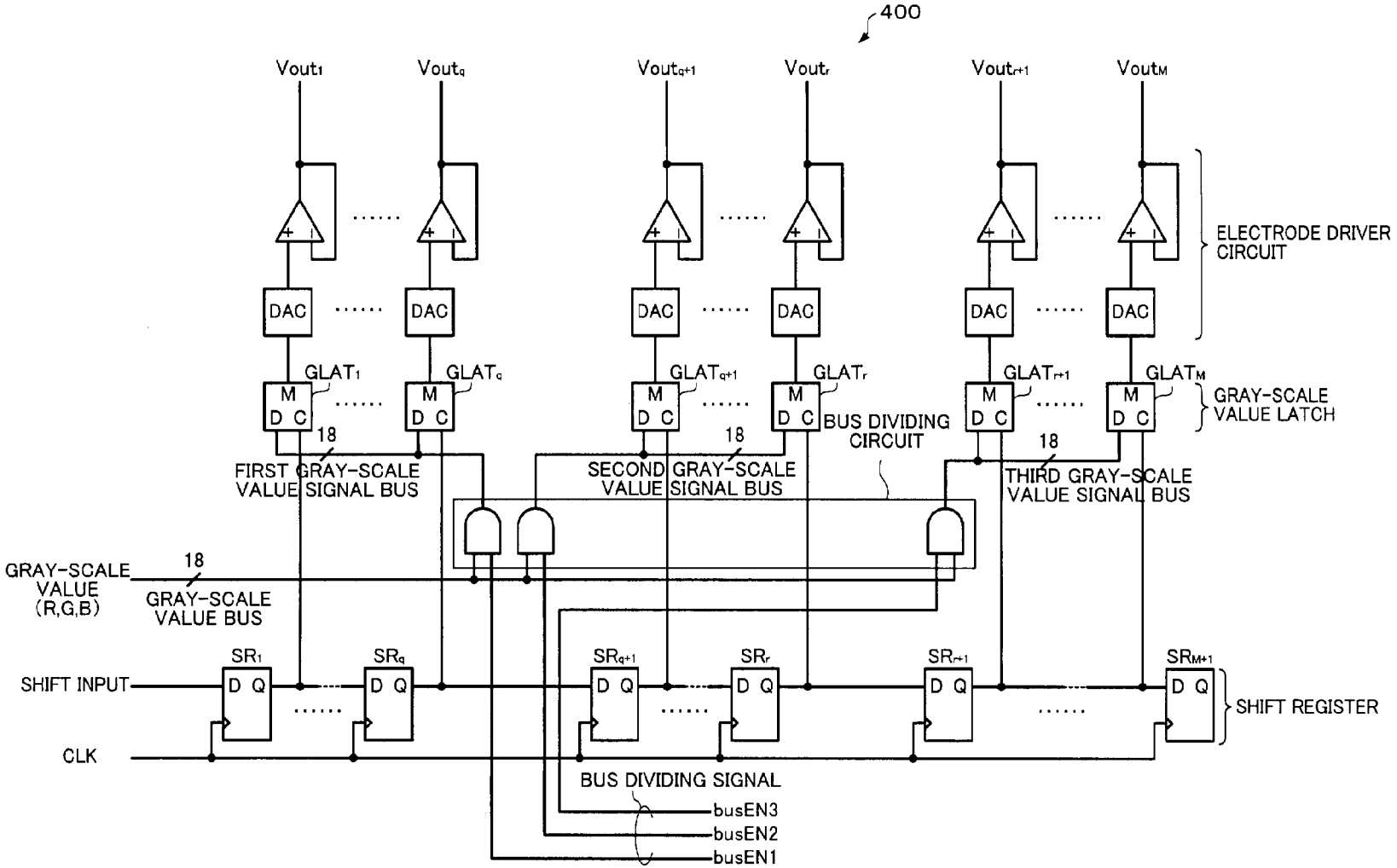
FIG. 25 is a block diagram showing an outline of a configuration of a signal driver to which a display driver circuit in the case where a gray-scale value bus is divided into three sections is applied.

In a signal driver 400 shown in FIG. 25, for example, the gray-scale value on the gray-scale value bus can be output to one of first to third gray-scale value signal buses by a bus dividing circuit 402 based on bus dividing signals busEN1 to busEN3. A switch margin period may be provided when switching the bus to which the bus dividing circuit outputs the gray-scale value from the first gray-scale value signal bus to the second gray-scale value signal bus, and the gray-scale value on the gray-scale value bus may be output to the first and second gray-scale value signal buses in the switch margin period. Similarly, a switch margin period may be provided when switching the bus to which the bus dividing circuit outputs the gray-scale value from the second gray-scale value signal bus to the third gray-scale value signal bus, and the gray-scale value on the gray-scale value bus may be output to the second and third gray-scale value signal buses in the switch margin period.

The above embodiments illustrate the case of driving a TFT liquid crystal device. However, the present invention may be applied to a simple matrix type liquid crystal device, an organic EL panel including organic EL elements, and a plasma display device.

What is claimed is:

1. A display driver circuit driving first to Mth (M is an integer of two or more) signal electrodes based on gray-scale values, the display driver circuit comprising:

a shift register, in which a plurality of flip-flops are connected in series, outputting shift output signals to be sequentially shifted based on a given clock;

a gray-scale value bus to which the gray-scale values are sequentially supplied corresponding to the clock;

first and second gray-scale value signal buses;

a bus dividing circuit outputting the gray-scale values supplied to the gray-scale value bus to one of the first and second gray-scale value signal buses, based on a given bus dividing signal, the bus dividing circuit having a first input connected to the gray-scale value bus for receiving the gray scale values, a second input for receiving the bus dividing signal, a first output connected to the first gray-scale value signal bus, and a second output connected to the second gray-scale value signal bus;

first to kth ($2 \leqq k < M$, k is an integer) gray-scale value latches being provided corresponding to first to kth signal electrodes among the first to Mth signal electrodes, and holding the gray-scale values supplied to the first gray-scale value signal bus based on the shift output signals from the shift register;

(k+1)th to Mth gray-scale value latches being provided corresponding to (k+1)th to Mth signal electrodes among the first to Mth signal electrodes, and holding the gray-scale values supplied to the second gray-scale value signal bus based on the shift output signals from the shift register; and an electrode driver circuit driving the first to Mth signal electrodes based on the gray-scale values held in the first to kth gray-scale value latches and the (k+1)th to Mth gray-scale value latches, wherein the gray-scale values on the first gray-scale value signal bus are fixed when the bus dividing circuit outputs the gray-scale values on the gray-scale bus to the second gray-scale value signal bus, and the gray-scale values on the second gray-scale value signal bus are fixed when the bus dividing circuit outputs the gray-scale values on the gray-scale bus to the first gray-scale value signal bus.

2. The display driver circuit as defined in claim 1, wherein the bus dividing signal is generated by using the shift output signals for taking one of the gray-scale values in the kth gray-scale value latch.

3. The display driver circuit as defined in claim 1, wherein the bus dividing signal is generated by using a count value of the clock supplied to the shift register.

4. The display driver circuit as defined in claim 1, wherein the bus dividing signal is generated based on one of the shift output signals, the shift output signals being output for each of blocks, the blocks being formed by dividing a plurality of the flip-flops forming the shift register.

5. The display driver circuit as defined in claim 1, wherein the bus dividing circuit outputs the gray-scale values to both of the first and second gray-scale value signal buses in a given period for switching from the first gray-scale value signal bus to the second gray-scale value signal bus based on the bus dividing signal.

6. The display driver circuit as defined in claim 5, wherein the given period is longer than at least a hold time of the kth gray-scale value latch and a setup time of the (k+1)th gray-scale value latch.

7. The display driver circuit as defined in claim 5, wherein the given period is specified by first and second shift output signals, the first and second shift output signals being output for each of blocks, the blocks being formed by dividing a plurality of the flip-flops forming the shift register.

8. A display driver circuit driving first to Mth (M is an integer of two or more) signal electrodes based on gray-scale values, the display driver circuit comprising:

a partial operation register being capable of arbitrarily setting whether or not to perform a partial operation for each of blocks, the blocks being formed by dividing the first to Mth signal electrodes;

a shift register, in which a plurality of flip-flops are connected in series, outputting shift output signals to be sequentially shifted based on a given clock;

a gray-scale value bus to which the gray-scale values are sequentially supplied corresponding to the clock;

first and second gray-scale value signal buses;

a bus dividing circuit outputting the gray-scale values supplied to the gray-scale value bus to one of the first and second gray-scale value signal buses, based on a given bus dividing signal, the bus dividing circuit having a first input connected to the gray-scale value bus for receiving the gray scale values, a second input for receiving the bus dividing signale, a first output connected to the first gray-scale value signal bus, and a second output connected to the second gray-scale value signal bus;

first to kth ($2 \leqq k < M$, k is an integer) gray-scale value latches being provided corresponding to first to kth signal electrodes among the first to Mth signal electrodes, and holding the gray-scale values supplied to the first gray-scale value signal bus based on the shift output signals from the shift register;

(k+1)th to Mth gray-scale value latches being provided corresponding to (k+1)th to Mth signal electrodes among the first to Mth signal electrodes, and holding the gray-scale values supplied to the second gray-scale value signal bus based on the shift output signals from the shift register; and first to Mth signal electrode driver circuits being provided corresponding to the first to Mth signal electrodes and driving the first to Mth signal electrodes based on the gray-scale values held in the first to Mth gray-scale value latches, wherein an ith ($1 \leqq i \leqq M$, i is an integer) signal electrode driver circuit among the first to Mth signal electrode driver circuits drives an ith signal electrode among the first to Mth signal electrodes by using the most significant bits of each color of the gray-scale values held in the ith gray-scale value latch when the ith signal electrode driver circuit belongs to a block designated by the partial operation register to perform the partial operation, and drives the ith signal electrode based on the gray-scale value held in the ith gray-scale value latch when the ith signal electrode driver circuit belongs to a block designated by the partial operation register not to perform the partial operation, and wherein the bus dividing circuit outputs only the most significant bits of each color of the gray-scale values corresponding to the block designated by the partial operation register to perform the partial operation, to either or both of the first and second gray-scale value signal buses, and wherein the gray-scale values on the first gray-scale value signal bus are fixed when the bus dividing circuit outputs the gray-scale values on the gray-scale bus to the second gray-scale value signal bus, and the gray-scale values on the second gray-scale value signal bus are fixed when the bus dividing circuit outputs the gray-scale values on the gray-scale bus to the first gray-scale value signal bus.

9. A display driver circuit driving first to Mth (M is an integer of two or more) signal electrodes based on gray-scale values, the display driver circuit comprising:

a clock bus to which a given clock is supplied;

first and second clock divided buses;

a clock bus dividing circuit outputting the clock supplied to the clock bus, to one of the first and second clock divided buses based on a given clock bus dividing signal, wherein the clock bus dividing circuit includes a first input connected to the clock bus for receiving the clock, a second input for receiving the clock bus dividing signal, a first output connected to the first clock divided bus, and a second output connected to the second clock divided bus;

a first shift register in which first to kth ($2 \leqq k < M$, k is an integer) flip-flops are connected in series and which outputs a shift output signal to be sequentially shifted based on the clock which has been output to the first clock divided bus;

a second shift register in which (k+1)th to Mth flip-flops are connected in series and which outputs the shift output signal which is an output of the kth flip-flop and sequentially shifted based on the clock which has been output to the second clock divided bus;

a gray-scale value bus to which the gray-scale value is sequentially supplied corresponding to the clock;

first to Mth gray-scale value latches which are provided corresponding to the first to Mth signal electrodes and hold the gray-scale value supplied to the gray-scale value bus based on the shift output signal from one of the first and second shift registers; and an electrode driver circuit which drives the first to Mth signal electrodes based on the gray-scale values held in the first to Mth gray-scale value latches, wherein the clock on the first clock bus is fixed when the clock bus dividing circuit outputs the clock on the clock bus to the second clock divided bus, and the clock on the second clock divided bus are fixed when the clock bus dividing circuit outputs the clock on the clock bus to the first clock divided bus.

10. The display driver circuit as defined in claim 9, wherein the clock bus dividing circuit outputs the clock supplied to the clock bus to both of the first and second clock divided buses in a given period for switching from the first clock divided bus to the second clock divided bus based on the clock bus dividing signal.

11. The display driver circuit as defined in claim 10, wherein the given period is at least one cycle of the clock.

12. A display driver circuit driving first to Nth (N is an integer of two or more) scan electrodes, the display driver circuit comprising:

a clock bus to which a given clock is supplied;

first and second clock divided buses;

a clock bus dividing circuit outputting the clock supplied to the clock bus, to one of the first and second clock divided buses based on a given clock bus dividing signal, wherein the clock bus dividing circuit includes a first input connected to the clock bus for receiving the clock, a second input for receiving the clock bus dividing signal, a first output connected to the first clock divided bus, and a second output connected to the second clock divided bus;

a first shift register in which first to jth ($1 \leqq j < N$, j is an integer) flip-flops are connected in series and which outputs a shift output signal to be sequentially shifted based on the clock which has been output to the first clock divided bus; and a second shift register in which (j+1)th to Nth flip-flops are connected in series and which outputs the shift output signal which has been sequentially shifted based on the clock output to the second clock divided bus, wherein the first to jth scan electrodes and the (j+1)th to Nth scan electrodes are driven by using a shift output of one of the first and second shift registers, and wherein the clock on the first clock bus is fixed when the clock bus dividing circuit outputs the clock on the clock bus to the second clock divided bus, and the clock on the second clock divided bus are fixed when the clock bus dividing circuit outputs the clock on the clock bus to the first clock divided bus, wherein the clock bus dividing circuit includes an input for receiving the clock bus dividing signal, a first output connected to the first clock bus, and a second output connected to the second clock bus.

13. The display driver circuit as defined in claim 12, wherein the clock bus dividing circuit outputs the clock supplied to the clock bus to both of the first and second clock divided buses in a given period for switching from the first clock divided bus to the second clock divided bus based on the clock bus dividing signal.

14. The display driver circuit as defined in claim 13, wherein the given period is at least one cycle of the clock.

15. A display panel comprising:

a plurality of signal electrodes and a plurality of scan electrodes intersecting each other;

pixels specified by the signal electrodes and the scan electrodes; and the display driver circuit as defined in claim 1 which drives the signal electrodes.

16. A display panel comprising:

a plurality of signal electrodes and a plurality of scan electrodes intersecting each other;

pixels specified by the signal electrodes and the scan electrodes; and the display driver circuit as defined in claim 2 which drives the signal electrodes.

17. A display panel comprising:

a plurality of signal electrodes and a plurality of scan electrodes intersecting each other;

pixels specified by the signal electrodes and the scan electrodes; and the display driver circuit as defined in claim 3 which drives the signal electrodes.

18. A display panel comprising:

a plurality of signal electrodes and a plurality of scan electrodes intersecting each other;

pixels specified by the signal electrodes and the scan electrodes; and the display driver circuit as defined in claim 4 which drives the signal electrodes.

19. A display panel comprising:

a plurality of signal electrodes and a plurality of scan electrodes intersecting each other;

pixels specified by the signal electrodes and the scan electrodes; and the display driver circuit as defined in claim 5 which drives the signal electrodes.

20. A display panel comprising:

a plurality of signal electrodes and a plurality of scan electrodes intersecting each other;

pixels specified by the signal electrodes and the scan electrodes; and the display driver circuit as defined in claim 6 which drives the signal electrodes.

21. A display panel comprising:

a plurality of signal electrodes and a plurality of scan electrodes intersecting each other;

pixels specified by the signal electrodes and the scan electrodes; and the display driver circuit as defined in claim 8 which drives the signal electrodes.

22. A display panel comprising:

a plurality of signal electrodes and a plurality of scan electrodes intersecting each other;

pixels specified by the signal electrodes and the scan electrodes; and the display driver circuit as defined in claim 9 which drives the signal electrodes.

23. A display panel comprising:

a plurality of signal electrodes and a plurality of scan electrodes intersecting each other;

pixels specified by the signal electrodes and the scan electrodes; and the display driver circuit as defined in claim 12 which drives the scan electrodes.

24. A display panel comprising:

a plurality of signal electrodes and a plurality of scan electrodes intersecting each other;

pixels specified by the signal electrodes and the scan electrodes; and the display driver circuit as defined in claim 13 which drives the scan electrodes.

25. The display driver circuit as defined in claim 1, wherein the bus dividing circuit comprises first and second decision gates and an inversion gate.

26. The display driver circuit as defined in claim 25, wherein the first input of the bus dividing circuit is connected to inputs of the first and second decision gates for receiving the gray scale values from the gray-scale value bus.

27. The display driver circuit as defined in claim 25, wherein the second input of the bus dividing circuit is connected to an input of the first decision gate via the inversion gate for receiving an inverted bus dividing signal.

28. The display driver circuit as defined in claim 25, wherein the second input of the bus dividing circuit is connected to an input of the second decision gate for receiving the bus dividing signal.

29. The display driver circuit as defined in claim 25, wherein the first output of the bus dividing circuit is connected to an output of the first decision gate for supplying the gray-scale values to the first gray-scale value signal bus.

30. The display driver circuit as defined in claim 25, wherein the second output of the bus dividing circuit is connected to an output of the second decision gate for supplying the gray-scale values to the second gray-scale value signal bus.

31. The display driver circuit as defined in claim 9, wherein the clock bus dividing circuit comprises first and second decision gates.

32. The display driver circuit as defined in claim 31, wherein the first input of the dock bus dividing circuit is connected to inputs of the first and second decision gates for receiving the clock from the dock bus.

33. The display driver circuit as defined in claim 31, wherein the second input of the clock bus dividing circuit is connected to inputs of the first and second decision gates for receiving the clock bus dividing signal.

34. The display driver circuit as defined in claim 31, wherein the first output of the clock bus dividing circuit is connected to an output of the first decision gate for supplying the clock to the first clock divided bus.

35. The display driver circuit as defined in claim 31, wherein the second output of the clock bus dividing circuit is connected to an output of the second decision gate for supplying the clock to the second clock divided bus.

36. The display driver circuit as defined in claim 1, wherein the bus dividing signal is generated corresponding to a shift timing of the shift register.

37. The display driver circuit as defined in claim 1, wherein the second input of the bus dividing circuit receives the bus dividing signal. from the shift register.

* * * * *